US011905137B2

(12) United States Patent
Inui

(10) Patent No.: US 11,905,137 B2
(45) Date of Patent: Feb. 20, 2024

(54) SHEET FEEDING DEVICE AND IMAGE FORMING APPARATUS

(71) Applicant: CANON KABUSHIKI KAISHA, Tokyo (JP)

(72) Inventor: Yuma Inui, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 243 days.

(21) Appl. No.: 17/407,286

(22) Filed: Aug. 20, 2021

(65) Prior Publication Data

US 2022/0063943 A1 Mar. 3, 2022

(30) Foreign Application Priority Data

Sep. 3, 2020 (JP) ..... 2020-148277
Aug. 2, 2021 (JP) ..... 2021-126405

(51) Int. Cl.
*B65H 5/06* (2006.01)
*B65H 7/02* (2006.01)

(52) U.S. Cl.
CPC ..... *B65H 5/062* (2013.01); *B65H 7/02* (2013.01); *B65H 2511/11* (2013.01); *B65H 2513/10* (2013.01); *B65H 2513/50* (2013.01)

(58) Field of Classification Search
CPC . B65H 5/062; B65H 7/02; B65H 7/08; B65H 9/166; B65H 85/00; B65H 2301/331; B65H 2511/11; B65H 2513/10; B65H 2513/50
See application file for complete search history.

(56) References Cited

U.S. PATENT DOCUMENTS

| | | | | |
|---|---|---|---|---|
| 7,792,479 | B2 | 9/2010 | Yasumoto | |
| 10,589,948 | B2 | 3/2020 | Inui | |
| 2005/0219645 | A1* | 10/2005 | Maruchi | H04N 1/00745 358/474 |
| 2006/0269337 | A1 | 11/2006 | Yasumoto | |
| 2009/0057994 | A1* | 3/2009 | Kondo | B65H 7/02 271/228 |
| 2010/0199475 | A1 | 8/2010 | Tremblay et al. | |
| 2010/0322653 | A1 | 12/2010 | Yasumoto | |
| 2011/0058828 | A1* | 3/2011 | Tsukamoto | G03G 15/65 399/45 |
| 2016/0159594 | A1* | 6/2016 | Shiokawa | B65H 1/04 271/265.01 |
| 2019/0367302 | A1 | 12/2019 | Inui | |

FOREIGN PATENT DOCUMENTS

JP 2007-004137 A 1/2007

OTHER PUBLICATIONS

Feb. 10, 2022 Extended European Search Report in European Patent Application No. 21192727.2.

* cited by examiner

*Primary Examiner* — Prasad V Gokhale
(74) *Attorney, Agent, or Firm* — Venable LLP

(57) ABSTRACT

A sheet feeding device includes a first feeding roller pair, an upstream feeding roller pair, a downstream feeding roller pair, a second feeding roller pair, a first detecting portion, a second detecting portion, a third detecting portion, and a controller. The controller calculates a sheet feeding speed on the basis of a first time and a first distance. The controller calculates a length of the sheet with respect to the sheet feeding direction on the basis of the sheet feeding speed, a second time, and a second distance. The controller controls a sheet feeding timing by the second feeding roller pair on the basis of information of the length of the sheet.

12 Claims, 21 Drawing Sheets

S3
S2
S1
12
S
11
13

S3
S2
S1
12
S
11
13

S3
S2
S1
12
11
S
13

S3
S2
S1
12
11
S
13

S3
S2
S1
12
11
S
13

S3
S2
S1
12
S
11
13

SHEET FEEDING DEVICE AND IMAGE FORMING APPARATUS

FIELD OF THE INVENTION AND RELATED ART

The present invention relates to a sheet feeding device for feeding a sheet and an image forming apparatus including the sheet feeding device.

Conventionally, an image forming apparatus having a function of printing images on double sides (surfaces) of the sheet exists. In such an image forming apparatus, in the case where the images are formed on the double sides of the sheet, first, the image is formed on a first surface (front surface) of the sheet. Thereafter, the sheet on which the image is formed on the first surface is reversed, and then, the image is formed on a second surface (back surface) of the sheet. As a type in which a front and a back of the sheet are reversed, a switch-back type is used in general. However, in the case of the switch-back type, with respect to a sheet feeding direction, a positional deviation of the images occurred between the front and the back of the sheets on which the images are formed.

In Japanese Laid-Open Patent Application (JP-A) 2007-4137, in a sheet feeding passage after the sheet is switched back, an upstream feeding roller pair and a downstream feeding roller pair are provided at different positions with respect to the sheet feeding direction. Further, a plurality of sensors are provided between the upstream feeding roller pair and the downstream feeding roller pair and at different positions with respect to the sheet feeding direction.

Further, a sheet feeding speed is calculated by measuring a time in which the sheet fed by the feeding rollers passes through the plurality of sensors, and thus a length of the sheet with respect to the sheet feeding direction is calculated. By this, a constitution in which the image on the second surface can be formed in conformity to the sheet length and thus a positional deviation between the front and back sides (surfaces) of the sheet is corrected is disclosed.

However, in the above-described constitution, after a trailing end of the sheet passes through the upstream feeding roller pair, the trailing end of the sheet is detected by the sensor. The sheet fed receives impact when it enters a nip of the downstream feeding roller pair, and therefore, there is a liability that the sheet feeding speed temporarily lowers. In this case, when the sheet length with respect to the sheet feeding direction is calculated, the calculation of the sheet length is influenced by a variation in sheet feeding speed, and therefore, a variation in sheet length occurs, with the result that there is a liability that the positional deviation between the images formed on the front and back sides of the sheet occurs.

SUMMARY OF THE INVENTION

A principal object of the present invention is to provide a sheet feeding device capable of reducing a degree of an occurrence of positional deviation between images formed on front and back sides of the sheet by accurately calculating a length of the sheet fed in a sheet feeding direction.

According to an aspect of the present invention, there is provided a sheet feeding device comprising: a first feeding roller pair rotatable in a sheet nipping state and configured to feed a sheet; an upstream feeding roller pair provided upstream of the first feeding roller pair with respect to a sheet feeding direction and configured to feed the sheet; a downstream feeding roller pair provided downstream of the first feeding roller pair with respect to the sheet feeding direction and configured to feed the sheet; a second feeding roller pair provided downstream of the downstream feeding roller pair with respect to the sheet feeding direction and configured to feed the sheet; a first detecting portion provided at a first detecting position downstream of the first feeding roller pair and upstream of the downstream feeding roller pair with respect to the sheet feeding direction and configured to detect passing of a leading end portion of the sheet fed by the first feeding roller pair; a second detecting portion provided at a second detecting position, different from the first detecting position, downstream of the first feeding roller pair and upstream of the downstream feeding roller pair with respect to the sheet feeding direction and configured to detect the passing of the leading end portion of the sheet fed by the first feeding roller pair; a third detecting portion provided at a third detecting position upstream of the first feeding roller pair and downstream of the upstream feeding roller pair with respect to the sheet feeding direction and configured to detect passing of a trailing end portion of the sheet fed by the first feeding roller pair; and a controller configured to perform calculation in response to signals from the first detecting portion, the second detecting portion, and the third detecting portion, wherein the controller calculates a sheet feeding speed on the basis of a first time which is a difference between a timing when the leading end portion of the sheet passes through the first detecting position and a timing when the leading end portion of the sheet passes through the second detecting position and a first distance between the first detecting position and the second detecting position with respect to the sheet feeding direction, wherein the controller calculates a length of the sheet with respect to the sheet feeding direction on the basis of the sheet feeding speed, a second time which is a difference between a timing when the leading end portion of the sheet passes through the second detecting position and a timing when the trailing end portion of the sheet passes through the third detecting position, and a second distance between the second detecting position and the third detecting position with respect to the sheet feeding direction, and wherein the controller controls a sheet feeding timing by the second feeding roller pair on the basis of information of the length of the sheet.

According to another aspect of the present invention, there is provided a sheet feeding device comprising: a first feeding roller pair rotatable in a sheet nipping state and configured to feed a sheet; an upstream feeding roller pair provided upstream of the first feeding roller pair with respect to a sheet feeding direction and configured to feed the sheet; a downstream feeding roller pair provided downstream of the first feeding roller pair with respect to the sheet feeding direction and configured to feed the sheet; a second feeding roller pair provided downstream of the downstream feeding roller pair with respect to the sheet feeding direction and configured to feed the sheet; a first detecting portion provided at a first detecting position upstream of the first feeding roller pair and downstream of the upstream feeding roller pair with respect to the sheet feeding direction and configured to detect passing of a trailing end portion of the sheet fed by the first feeding roller pair; a second detecting portion provided at a second detecting position, different from the first detecting position, upstream of the first feeding roller pair and downstream of the upstream feeding roller pair with respect to the sheet feeding direction and configured to detect the passing of the trailing end portion of the sheet fed by the first feeding roller pair; a third detecting portion provided at a third detecting position downstream of the first feeding roller pair and upstream of the downstream feeding roller pair with respect to the sheet feeding direction and configured to detect passing of a leading end portion of the sheet fed by the first feeding roller pair; and a controller configured to perform calculation in response to signals from the first detecting portion, the second detecting portion, and the third detecting portion, wherein when the leading end portion of the sheet fed by the first feeding roller pair is detected by the third detecting portion, the trailing end portion of the sheet passes through the upstream feeding roller pair, and wherein when the trailing end portion of the sheet fed by the first feeding roller pair is detected by the first detecting portion and the second detecting portion, the leading end portion does not reach the downstream feeding roller pair, wherein the controller calculates a sheet feeding speed on the basis of a first time which is a difference between a timing when the trailing end portion of the sheet passes through the first detecting position and a timing when the trailing end portion of the sheet passes through the second detecting position and a first distance between the first detecting position and the second detecting position with respect to the sheet feeding direction, wherein the controller calculates a length of the sheet with respect to the sheet feeding direction on the basis of the sheet feeding speed, a second time which is a difference between a timing when the leading end portion of the sheet passes through the third detecting position and a timing when the trailing end portion of the sheet passes through the second detecting position, and a second distance between the second detecting position and the third detecting position with respect to the sheet feeding direction, and wherein the controller controls a sheet feeding timing by the second feeding roller pair on the basis of information of the length of the sheet.

According to a further aspect of the present invention, there is provided a sheet feeding device comprising: a first feeding roller pair rotatable in a sheet nipping state and configured to feed a sheet; an upstream feeding roller pair provided upstream of the first feeding roller pair with respect to a sheet feeding direction and configured to feed the sheet; a downstream feeding roller pair provided downstream of the first feeding roller pair with respect to the sheet feeding direction and configured to feed the sheet; a second feeding roller pair provided downstream of the downstream feeding roller pair with respect to the sheet feeding direction and configured to feed the sheet; a first reading portion provided so as to extend along the sheet feeding direction on a side downstream of the first feeding roller pair and upstream of the downstream feeding roller pair with respect to the sheet feeding direction and configured to read an image of a leading end portion of the sheet fed by the first feeding roller pair; a second reading portion provided so as to extend along the sheet feeding direction on a side upstream of the first feeding roller pair and downstream of the upstream feeding roller pair with respect to the sheet feeding direction and configured to read an image of the trailing end portion of the sheet fed by the first feeding roller pair; and a controller configured to perform calculation depending on the images read by the first reading portion and the second reading portion, wherein when the image of the leading end portion of the sheet fed by the first feeding roller pair is read by the first reading portion, the trailing end portion of the sheet passes through the upstream feeding roller pair, and wherein when the image of the trailing end of the sheet fed by the first feeding roller pair is read by the second reading portion, the leading end portion does not reach the downstream feeding roller pair, wherein the controller calculates a sheet feeding speed on the basis of a fifth time which is a difference between timings of a plurality of images read by the first reading portion and a fifth distance which is a difference in position of the leading end portion of the sheet between the plurality of images, wherein the controller calculates a length of the sheet on the basis of a sixth time which is a difference in timing between the image read by the first reading portion and the image read by the second reading portion, and wherein the controller controls a sheet feeding timing by the second feeding roller pair on the basis of information of the length of the sheet.

Further features of the present invention will become apparent from the following description of exemplary embodiments with reference to the attached drawings.

DESCRIPTION OF THE EMBODIMENTS

In the following, embodiments for carrying out the present invention will be described with reference to the drawings.

Embodiment 1

<General Structure of Image Forming Apparatus>

Figure 1:
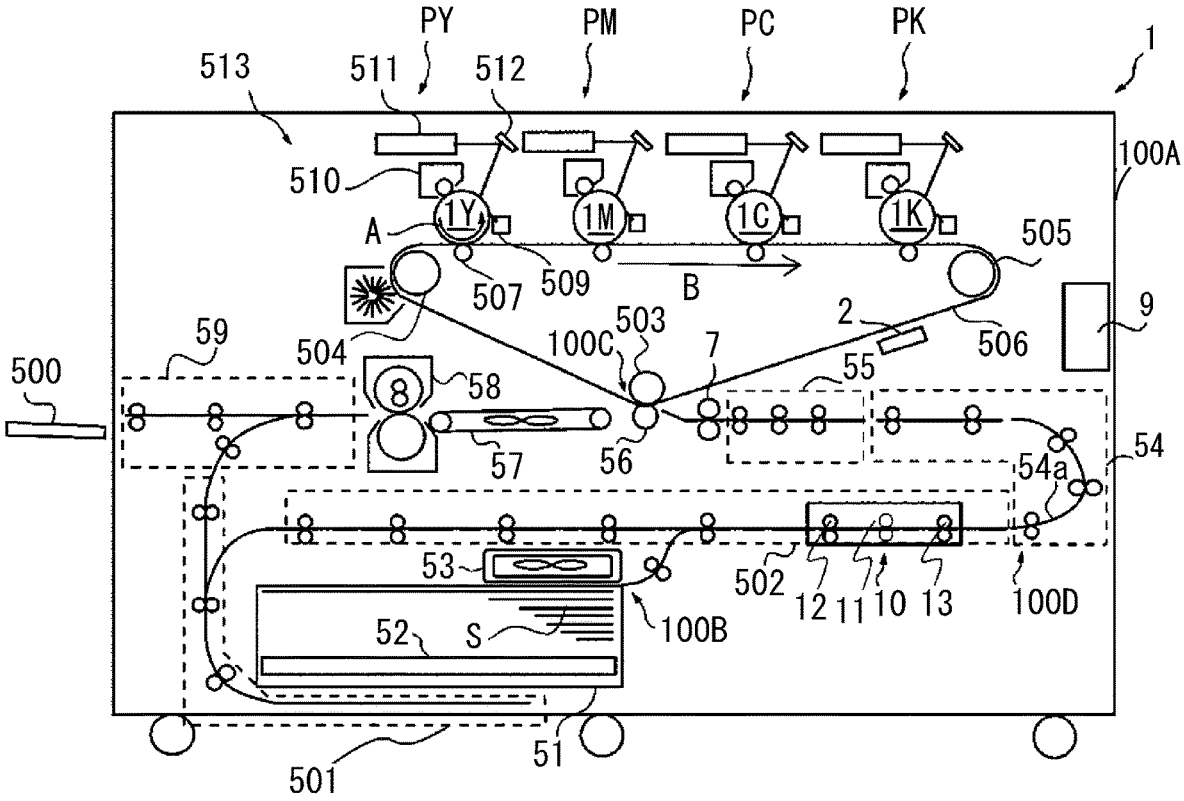
FIG. 1 is a schematic structural view of an image forming apparatus of an embodiment 1.

First, a schematic structure of a printer 1 as an example of an image forming apparatus including a sheet feeding device of an embodiment 1 will be described. FIG. 1 is a schematic structural view of the printer 1. The printer 1 includes a controller for controlling an entire operation of the printer 1 on the bases of image information inputted from an external PC or image information read from an original. The printer 1 is an apparatus, such as a printer, a copying machine, a facsimile machine, a multi-function machine, and the like, in which an image is formed on a sheet used as a recording medium (material). Further, the printer 1 is capable of meeting printing other than printing for general business purposes, and is capable of using, as the recording medium (material) various sheets including paper such as a form or an envelope, glossy paper, a plastic film such as an overhead projector (OHP) sheet, a cloth and the like.

In an apparatus main assembly 100A of the printer 1, a feeding cassette 51 for accommodating sheets S and an image forming engine 513 for forming an image on the sheet S fed from the feeding cassette 51 are accommodated. The image forming engine 513 which is an example of an image forming means includes four image forming portions PY, PM, PC and PK for forming toner images of yellow, magenta, cyan and black, respectively, and an intermediary transfer belt 506. The image forming engine 513 forms the image on the sheet S by a tandem intermediary transfer type. The image forming portions PY to PK are electrophotographic units including photosensitive drums 1Y, 1M, 1C and 1K, respectively, which are photosensitive members.

The image forming portions PY to PK achieve commonality of constitutions thereof except that colors of toners used for development are different from each other. In this embodiment, a structure and a toner image forming process of the image forming engine 513 will be described by using the image forming portion PY for yellow as an example. The image forming portion PY includes, in addition to the photosensitive drum 1Y, an exposure device 511, a developing device 510 and a drum cleaner 509. The photosensitive drum 1Y is a drum-shaped photosensitive member including a photosensitive layer at an outer peripheral portion and rotates in a direction (arrow A direction in FIG. 1) along a rotational direction (arrow B direction in FIG. 1) of the intermediary transfer belt 506. A surface of the photosensitive drum 1Y is electrically charged by being supplied with electric charges from a charging means such as a charging roller. The exposure device 511 emits laser light modulated depending on image information, so that the surface of the photosensitive drum 1Y is scanned with the laser light by an optical system including a reflecting device 512 or the like, and thus an electrostatic latent image is formed on the surface of the photosensitive drum 1Y. The developing device 510 accommodates a developer containing the toner and visualizes (develops) the electrostatic latent image into a toner image by supplying the toner to the surface of the photosensitive drum 1Y. The toner image formed on the photosensitive drum 1Y is primary-transferred onto the intermediary transfer belt 506 in a primary transfer portion which is a nip between the intermediary transfer belt 506 and a primary transfer roller 507. Residual toner remaining on the photosensitive drum 1Y after the transfer is removed by the drum cleaner 509.

The intermediary transfer belt 506 is extended and wound around a driving roller 504, a follower roller 505, an inner secondary transfer roller 503 and primary transfer roller 507, and is rotationally driven in the clockwise direction (arrow B direction) in FIG. 1 by the driving roller 504. The image forming process described above is performed in the image forming portions PY to PK in parallel, and the four color toner images are transferred in a multiple-transfer manner so as to be superposed on each other, so that a full-color image is formed on the intermediary transfer belt 506. These toner images for the full-color image are fed to a secondary transfer portion 100C by being carried on the intermediary transfer belt 506. The secondary transfer portion 100C is constituted as a nip between a secondary transfer roller 56 as a transfer means and the inner secondary transfer roller 503. To the secondary transfer roller 56, a bias voltage of a polarity opposite to a charge polarity of the toner is applied. By this, the toner images are secondary-transferred onto the sheet S. Residual toner remaining on the intermediary transfer belt 506 after the transfer is removed by a belt cleaner.

The sheet S on which the toner image is transferred is delivered to a fixing unit 58 by a pre-fixing feeding portion 57. The fixing unit 58 includes a fixing roller pair for feeding the sheet S while nipping the sheet S and a heat source such as a halogen heater, and applies heat and pressure to the toner image carried on the sheet S. By this, toner particles are melted and fixed, so that the toner image is fixed on the sheet S.

Next, a sheet feeding process for feeding the sheet will be described. A sheet feeding system 100D as a sheet feeding device of this embodiment feeds the sheet S accommodated in the feeding cassette 51 and for discharges the sheet S, on which the image is formed, to an outside of the apparatus main assembly 100A. The sheet feeding system 100D includes a sheet feeding portion 53, a sheet conveying portion 54, an oblique movement correcting portion 55, a branch feeding (conveying) portion 59, a reverse feeding (conveying) portion 501, and a double-side feeding (conveying) portion 502. The feeding cassette 51 is mounted in the apparatus main assembly 100A so as to be capable of being pulled out and in which the sheets S are accommodated in a stacked state on a raising and lowering plate 52 which is capable of being raised and lowered. The sheets S are fed one by one by the sheet feeding portion 53. As a type of the feeding portion 53, it is possible to cite a belt type in which the sheet S is attracted to a belt member by a suction fan and then is fed and a friction separation type using a roller or a pad. The sheet S fed from the feeding portion 53 is fed along a feeding passage 54*a* by a feeding roller pair of the sheet conveying portion 54, and then is delivered to the oblique movement correcting portion 55.

The sheet S delivered to the oblique movement correcting portion 55 is subjected to oblique movement correction and timing correction and then is fed toward the secondary transfer portion 100C. At this time, a registration roller pair 7 included in the oblique movement correcting portion 55 sends the sheet S to the secondary transfer portion 100C at timing synchronized with a degree of progress of the image forming process by the image forming portions PY to PK. The sheet S on which the toner image is transferred in the secondary transfer portion 100C and on which the image is fixed by the fixing unit 58 is fed to the branch feeding portion 59 for branching a feeding passage of the sheet S. In the case where the image formation on the sheet S is completed, the sheet S is discharged by a discharging roller pair onto the discharge tray 500 disposed outside the apparatus main assembly 100A. In the case where the image is formed on a back surface (side) of the sheet S, the sheet S is delivered to the double-side feeding portion 502 through the reverse feeding portion 501. The reverse feeding portion 501 includes a reverse roller pair capable of being rotated normally and reversely and then delivers the sheet S to the double-side feeding portion 502 in a state in which the front and back of the sheet S are reversed by a switch-back type in which the front and back of the sheet S are reversed. The double-side feeding portion 502 feeds the sheet S toward the oblique movement correcting portion 55 again through the sheet feeding portion 54. After the image is formed on the back surface of the sheet S, the sheet S is discharged onto the discharge tray 500.

As described above, the image forming apparatus 1 operates an "image forming process" and a "sheet feeding process" in interrelation with each other, whereby formation of the image on the sheet S is achieved.

<Constitution for Calculating Length of Sheet with Respect to Feeding Direction in Reference Example>

Incidentally, conventionally, as a type in which the front and back of the sheet are reversed in the image forming apparatus, the above-described switch-back type has been used in general because the constitution is easy and is advantageous in terms of a space. However, in the case of the switch-back type, a leading end and a trailing end of the sheet are changed to each other, and therefore, even when a mechanism for correcting the oblique movement of the sheet is provided, a positional deviation of the images, formed on the sheet, on the front and back sides (surfaces) occurs. This is because a dimension variation of the sheet due to cut variation of the sheet, and fiber contraction, expansion and the like of the sheet depending on an absorption amount of water content in the air occurs. Particularly, as regards the fiber contraction of the sheet, in the case where the image is formed on the back surface of the sheet after the image is formed on the front surface of the sheet, the sheet is once heated and pressed by the fixing unit, and therefore, the sheet contraction is liable to occur. In this case, when timings of the toner image and the leading end of the sheet are only uniformly conformed to each other on a leading end basis, in which the image is formed on the front surface of the sheet, during transfer of the image onto the back surface of the sheet, the positional deviation of the images, formed on the sheet, on the front and back sides occurs. Then, by the occurrence of such a positional deviation, a quality of a print product lowers due to occurrence of an image defect in a processing step such as trimming or folding after the printing, and a margin to a subsequent page.

Figure 2:
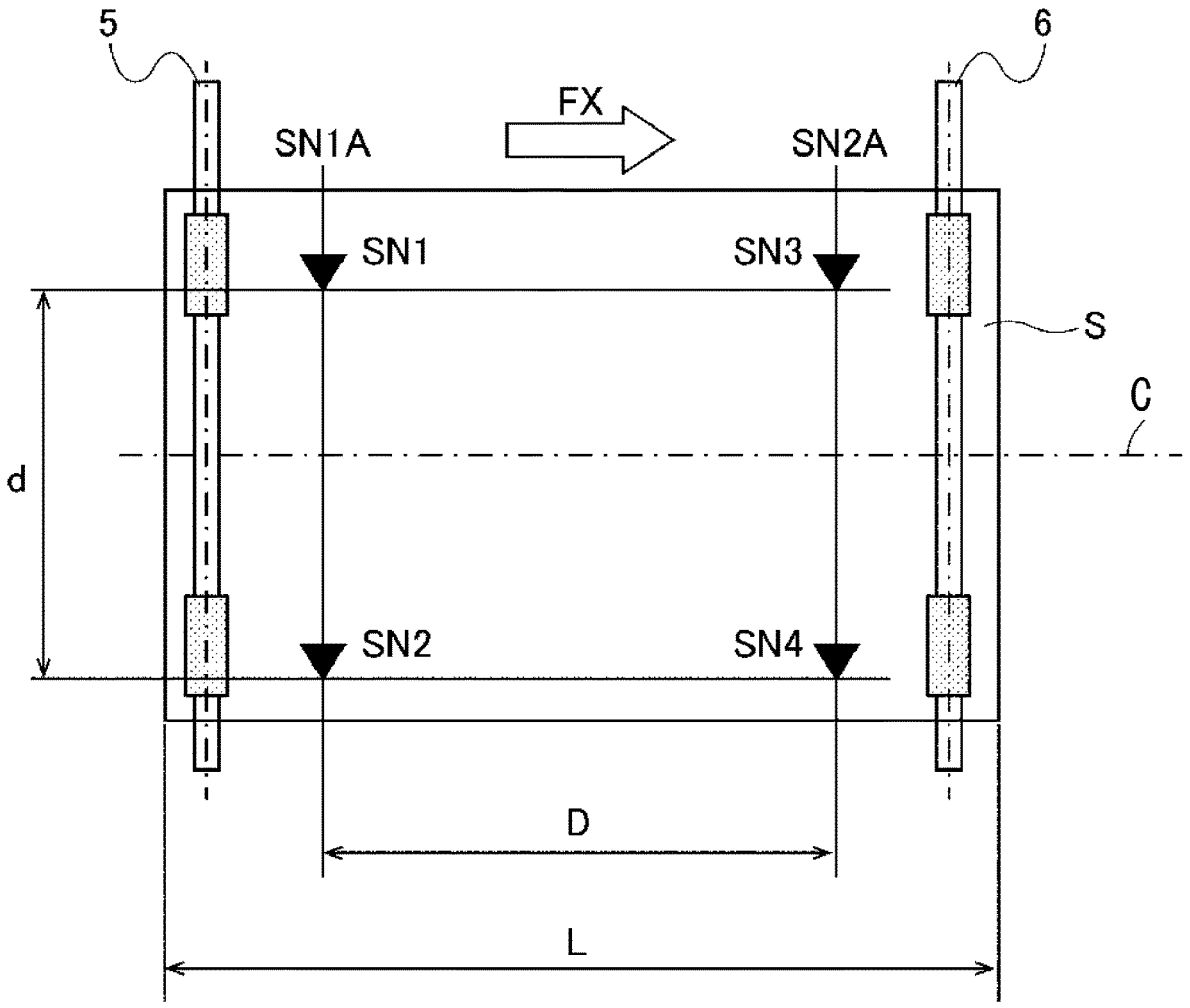
FIG. 2 is a schematic view showing a constitution for calculating a sheet feeding speed and a length of a sheet with respect to a (sheet) feeding direction in a reference example.

In order to solve this problem, as shown in FIG. 2, a constitution in which in the double-side feeding portion of the image forming apparatus, sensors for detecting passing of the sheet are provided to each of two detecting portions SN1A and SN2A and in which a sheet feeding speed and a sheet length with respect to the (sheet) feeding direction are calculated on the basis of signals sent from the sensors has been known. After the sheet length is calculated, the controller controls a sheet feeding timing to the secondary transfer portion by the oblique movement correcting portion on the basis of information of the calculated sheet length. Specifically, in the case where the controller discriminated that the calculated sheet length is shorter than the information of the sheet length, the sheet feeding timing to the secondary transfer portion by the oblique movement correcting portion is made late. On the other hand, in the case where the controller discriminated that the calculated sheet length is longer than the information of the sheet length, the sheet feeding timing to the secondary transfer portion by the oblique movement correcting portion is made early.

Thus, the sheet length is detected and the sheet feeding timing by the oblique movement correcting portion is controlled, so that it becomes possible to know a reference position of a sheet end portion during formation of the image on a first surface (front surface) even if the leading end and the trailing end of the sheet are changed to each other when the image is formed on a second surface (back surface). As a result, the position of the image formed on the first surface (front surface) is known, and therefore, the image on the second surface (back surface) is formed in conformity to the reference position of the sheet end portion during the formation of the image on the first surface (front surface), so that it is possible to prevent the positional deviation of the images, formed on the sheet, on the front and back sides.

FIG. 2 is a top (plan) view illustrating a constitution for detecting passing of the sheet in a conventional image forming apparatus as a reference example. In FIG. 2, as the reference example, feeding rollers 5 and 6 provided at the double-side feeding portion of the conventional image forming apparatus, and the detecting portions SN1A and SN2A provided between the feeding rollers 5 and 6 with respect to the feeding direction are shown. The detecting portion SN1A disposed on an upstream side with respect to the feeding direction is provided with two sensors SN1 and SN2 disposed with an interval d while sandwiching a center with respect to a widthwise direction perpendicular to the feeding direction in a sheet feeding passage (hereinafter, referred to as a feeding center C). Similarly, the detecting portion SN2A disposed downstream of the detecting portion SN1A is provided with two sensors SN3 and SN4 disposed with the interval d while sandwiching the feeding center C.

Figure 3:
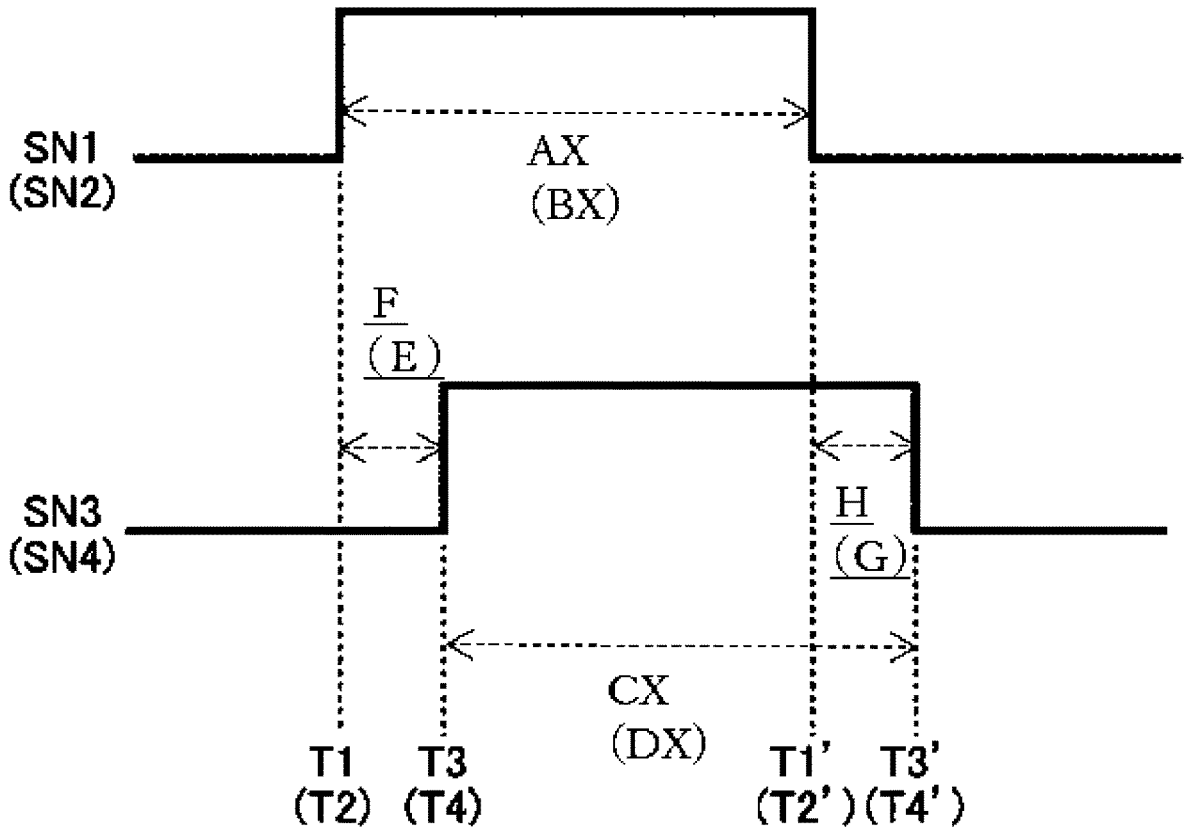
FIG. 3 is an output diagram of signals in a constitution for detecting passing of the sheet in the reference example.

Further, when the sheet S fed in an arrow FX direction in FIG. 2 passes through the detecting portions SN1A and SN2A, signals as shown in FIG. 3 are outputted from the sensors SN1, SN2, SN3 and SN4. FIG. 3 is an output diagram of the signals in a constitution for detecting passing of the sheet in a reference example. Incidentally, in FIG. 3, T1 and T2 are times when the sensors SN1 and SN2 of the detecting portion SN1A detect passing of a sheet leading end. T3 and T4 are times when the sensors SN3 and SN4 of the detecting portion SN2A detect the passing of the sheet leading end. T1' and T2' are times when the sensors SN1 and SN2 detect passing of a sheet trailing end. T3' and T4' are times when the sensors SN3 and SN4 detect the passing of the sheet trailing end. Incidentally, in FIG. 3, it is assumed that the sheet is fed by the feeding rollers 5 and 6 of FIG. 2 so that a rectilinear line showing the feeding center C and each of the sheet leading end and the sheet trailing end are distance each other.

Here, when a necessary time for passing of the leading end of the sheet S through between the sensors SN1 and SN3 is a time F, the time F=T3−T1 holds. On the other hand, when a necessary time for passing of the leading end of the sheet S through between the sensors SN2 and SN4 is a time E, the time E=T4−T2 holds. Further, a necessary time for passing of the trailing end of the sheet S through between the sensors SN1 and SN3 is a time H, the time H=T3'−T1' holds. On the other hand, a necessary time for passing of the trailing end of the sheet S through between the sensors SN2 and SN4 is a time G, the time G=T4'−T2' holds. Further, on the basis of the times E, F, G and H and a distance D between the detecting portions SN1A and SN2A, a feeding speed of the sheet S is calculated. Incidentally, in order to average the influence of the feeding rollers 5, 6, and the like, an average Avg (E, F, G, H) of the times E, F, G and H is taken as a time in which the sheet S is fed over the distance D, and a feeding speed VEX is calculated in accordance with the following (formula 1).

$$\text{Feeding speed } VEX = D/\text{Ave}(E,F,G,H) \quad \text{(formula 1)}$$

Further, when a necessary time for passing, through the sensor SN1, from the leading end of the sheet S to the trailing end of the sheet S is a time AX and a necessary time for passing, through the sensor SN2, from the leading end of the sheet S to the trailing end of the sheet S is a time BX, the time AX=T1'−T1 and the time BX=T2'−T2 hold. Further, when a necessary time for passing, through the sensor SN3, from the leading end of the sheet S to the trailing end of the sheet S is a time CX and a necessary time for passing, through the sensor SN4, from the leading end of the sheet S to the trailing end of the sheet S, i.e., entirety of the sheet S, is a time DX, the time CX=T3'−T3 and the time DX=T4'−T4 hold. Further, in order to average the influence of the rollers 5, 6, and the like, on the basis of an average Avg (Ax, BX, CX, DX) and the feeding speed VEX calculated in the (formula 1), a length L of the sheet S with respect to the feeding direction is calculated in accordance with the following (formula 2).

$$\text{Length } L = VEX \times \text{Avg}(AX,BX,CX,DX) \quad \text{(formula 2)}$$

Figure 4A:
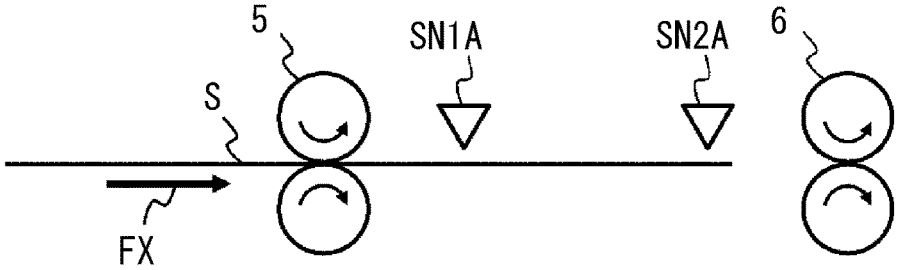
FIG. 4A to FIG. 4D are sectional views for illustrating behavior of a sheet S in the reference example.
Figure 4B:
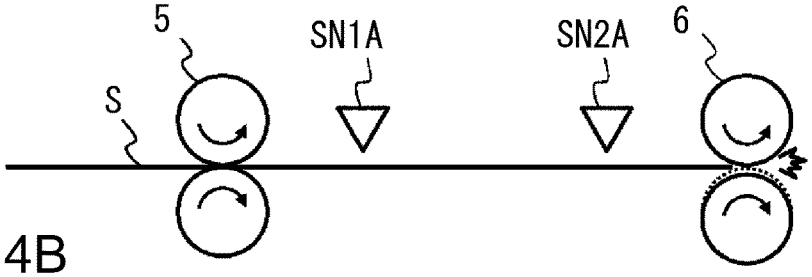
Figure 4C:
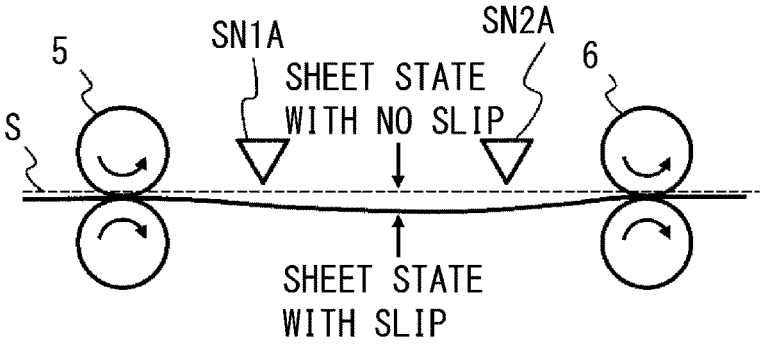
Figure 4D:
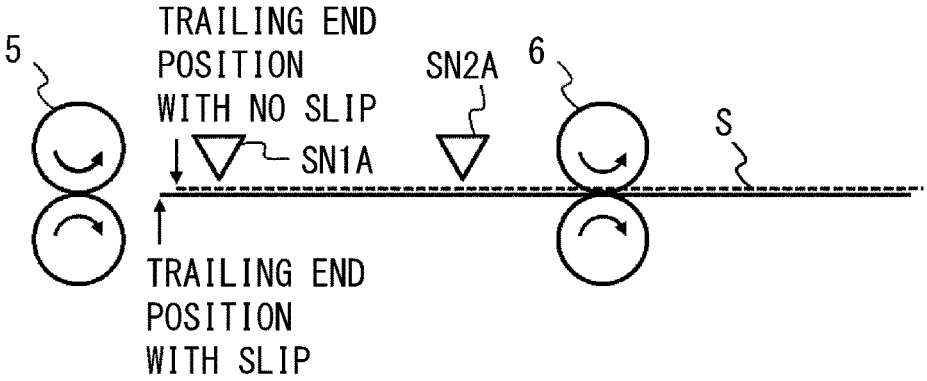

Next, behavior of the sheet S when the sheet S passes through the feeding rollers 5 and 6 in the reference example will be described with reference to FIG. 4A to FIG. 4D. FIG. 4A to FIG. 4D are sectional views for illustrating the behavior of the sheet S in the reference example. As shown in FIG. 4A, when an end portion of the sheet S is detected by the detecting portions SN1A and SN2A, the sheet S is fed toward the feeding roller 6 in a state in which the sheet S is nipped by the feeding roller (pair) 5. Here, as shown in FIG. 4B, when the sheet S enters the feeding roller 6, "bound behavior" such that the feeding roller 6 bounds in a direction as indicated by a broken line is observed. In FIG. 4B, a position of the feeding roller 6 bounded by entrance of the sheet S is indicated by the broken line. Incidentally, this bound behavior becomes conspicuous with an increased feeding speed for ensuring productivity of a sheet feeding operation or with an increased thickness. Further, when the bound behavior occurs, the sheet S and the feeding roller 6 cause a slip therebetween at the instant when a nip pressure for nipping the sheet S by the feeding roller 6 is released (eliminated). As a result of the slip, as shown in FIG. 4C, the feeding roller 6 nips the sheet S at a position different from the position when the slip does not occurred in some instances. Further, when passing of the trailing end of the sheet S is detected by the detecting portions SN1A and SN2A, the sheet S is fed in a state in which the slip occurred (FIG. 4D). Accordingly, a positional deviation due to the slip between the sheet S and the feeding roller 6 occurs. As a result, an error occurs when the passing of the trailing end of the sheet S is detected, so that there is a liability that measurement accuracy of the length of the sheet S with respect to the feeding direction lowers. The measurement accuracy of the length of the sheet S has the influence on a timing when the oblique movement correcting portion feeds the sheet S to the secondary transfer portion and leads to a positional deviation of the images, formed on the sheet S, on the front and back sides (surfaces).

<Constitution for Calculating Sheet Length with Respect to Feeding Direction in Embodiment 1>

Figure 5:
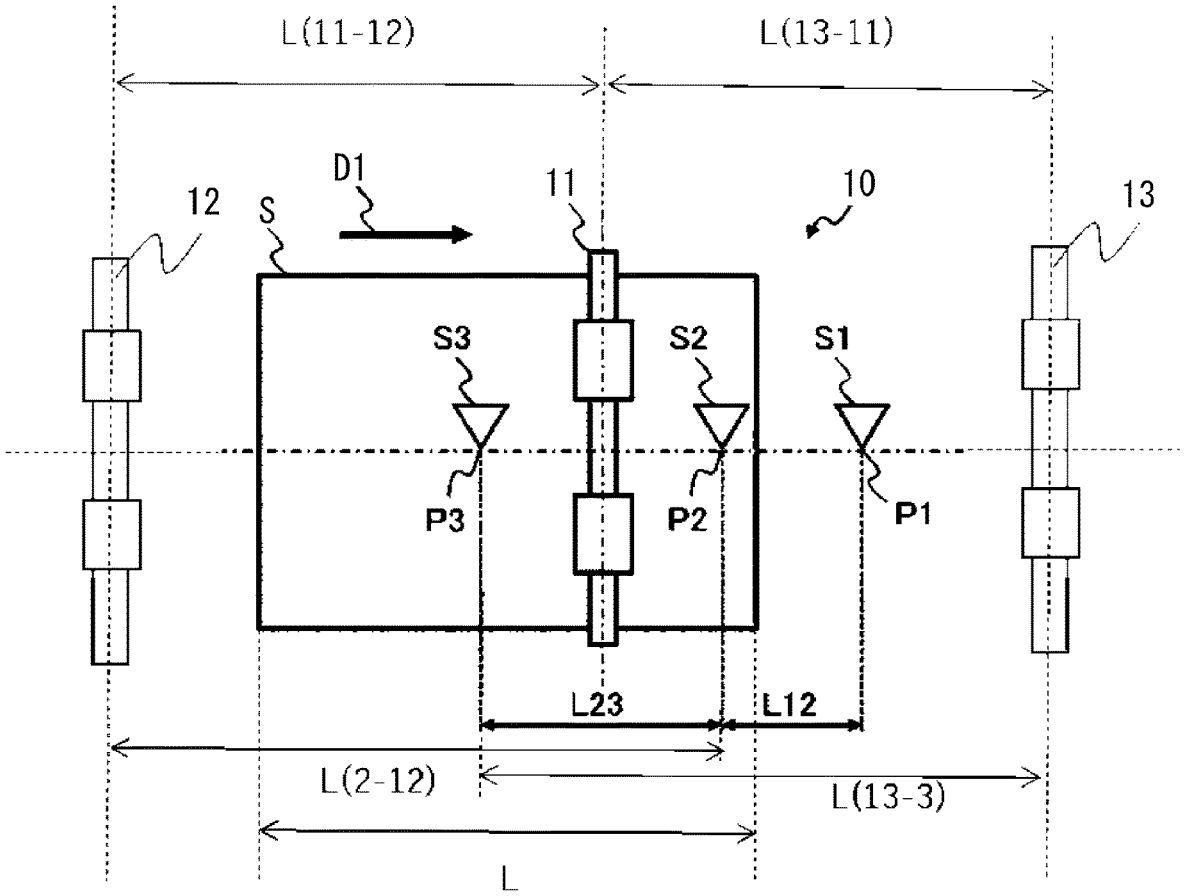
FIG. 5 is a top (plan) view showing a structure of a sheet detecting unit in the embodiment 1.

Next, a constitution for detecting the sheet length with respect to the feeding direction in the embodiment 1 will be described. FIG. 5 is a top (plan) view showing a structure of a sheet detecting unit 10 for detecting the sheet length with respect to the feeding direction in the embodiment 1. As regards the sheet detecting unit 10, description will be made assuming that the sheet detecting unit 10 is disposed at a double-side feeding portion 502, but the sheet detecting unit 10 can also be disposed at a position other than the double-side feeding portion 502 when the sheet detecting unit 10 is on a feeding passage on which the sheet S is fed in the printer 1.

The sheet detecting unit 10 includes a feeding roller pair 11 for feeding the sheet S, and a first detecting portion S1, a second detecting portion S2, and a third detecting portion S3 which are used for detecting passing of end portions (leading end and trailing end) of the sheet S. As regards the feeding roller pair 11 in this embodiment, peripheral surfaces of respective rollers contactable to the sheet S have been subjected to blasting, and metal is used as a material of the rollers. For this reason, a change in outer diameter due to temperature and humidity is smaller than a rubber roller used in general, and the slip of the sheet S does not readily occur, so that feeding of the sheet S can be controlled accurately and stably. Further, with respect to a sheet feeding direction D1, the first detecting portion S1 and the second detecting portion S2 are disposed downstream of the feeding roller pair 11. With respect to the (sheet) feeding direction D1, the third detecting portion S3 is disposed upstream of the feeding roller pair 11. Further, an upstream feeding roller pair 12 for feeding the sheet S is provided upstream of the third detecting portion S3, and a downstream feeding roller pair 13 for feeding the sheet S is provided downstream of the first detecting portion S1.

The first detecting portion S1 detects the passing of the end portions (leading end and trailing end) of the sheet S at a first detecting position P1 on a side downstream of the feeding roller pair 11 with respect to the feeding direction D1. Further, the second detecting portion S2 detects the passing of the end portions (leading end and trailing end) of the sheet S at a second detecting position P2 which is on a side downstream of the feeding roller pair 11 with respect to the feeding direction D1 and which is different from the first detecting position P1. Further, the third detecting portion S3 detects the end portions (leading end and trailing end) of the sheet S at a third detecting position P3 on a side upstream of the feeding roller pair 11 with respect to the feeding direction D1. In FIG. 5, an example in which each of the first detecting position P1, the second detecting position P2, and the third detecting position P3 is detected at a center of the sheet S with respect to a widthwise direction perpendicular to the feeding direction D1 is shown.

Further, in FIG. 5, a distance between the first detecting position P1 and the second detecting position P2 with respect to the feeding direction D1 is indicated as L12, and a distance between the second detecting position P2 and the third detecting position P3 with respect to the feeding direction D1 is indicated as L23. Incidentally, the first detecting portion S1 is constituted by including an optical sensor which outputs a Low signal in the case where the sheet S is not present and which outputs a High signal in the case where the sheet S is present. Also, as regards the second detecting portion S2 and the third detecting portion S3, the same sensor as the first detecting portion S1 is used. Accordingly, by passing of the leading end of the sheet S, the signal outputted from the sensor of each of the first detecting portion S1, the second detecting portion S2, and the third detecting portion S3 is switched from Low to High. Further, by passing of the trailing end of the sheet S, the signal outputted from the sensor of each of the first detecting portion S1, the second detecting portion S2, and the third detecting portion S3 is switched from High to Low. Accordingly, the controller 9 is capable of recognizing passing timings of the leading end or the trailing end of the sheet at the first detecting position P1, the second detecting position P2, and the third detecting position P3 in response to signals outputted from the sensors of the first detecting portion S1, the second detecting portion S2, and the third detecting portion S3, respectively. Further, the controller 9 is capable of calculating the feeding speed V of the sheet S and the length of the sheet S with respect to the feeding direction D1 on the basis of passing timings of the leading end or the trailing end of the sheet S at the first detecting position P1, the second detecting position P2, and the third detecting position P3. Further, in the case where the length of the sheet S is L, a length between the feeding roller pair 11 and the upstream feeding roller pair 12 is L (11–12), a length between the downstream feeding roller pair 13 and the feeding roller pair 11 is L (13–11), a length between the second detecting portion S2 and the upstream feeding roller pair 12 is L (2–12), and a length between the downstream feeding roller pair 13 and the third detecting portion S3 is a L (13–3), the feeding roller pairs and the detecting portions are detected so as to satisfy the following relationships:

$$L>L(11-12) \text{ and } L>L(13-11) \quad \text{formula (3)}$$

$$L(2-12)>L \text{ and } L(13-3)>L \quad \text{formula (4)}$$

As regards the respective feeding roller pairs and the respective detecting portions, by disposing the feeding roller pairs and the detecting portions so as to satisfy the relationships of the formula (3) and the formula (4), the sheet detecting unit 10 is capable of detecting the leading end and the trailing end of the sheet S by the first detecting portion, the second detecting portion, and the third detecting portion in a state in which the sheet S is not nipped by the upstream feeding roller pair and the downstream feeding roller pair during feeding of the sheet S by the feeding roller pair 11. That is, when the sheet length is calculated, it becomes possible to calculate the sheet length before the leading end of the sheet is nipped by the downstream feeding roller pair. That is, vibration of the sheet due to the nipping of the leading end of the sheet by the downstream feeding roller pair can be suppressed, so that it becomes possible to detect the sheet length with accuracy.

Figures 6A, 6B, 6C, 6D, 6E:
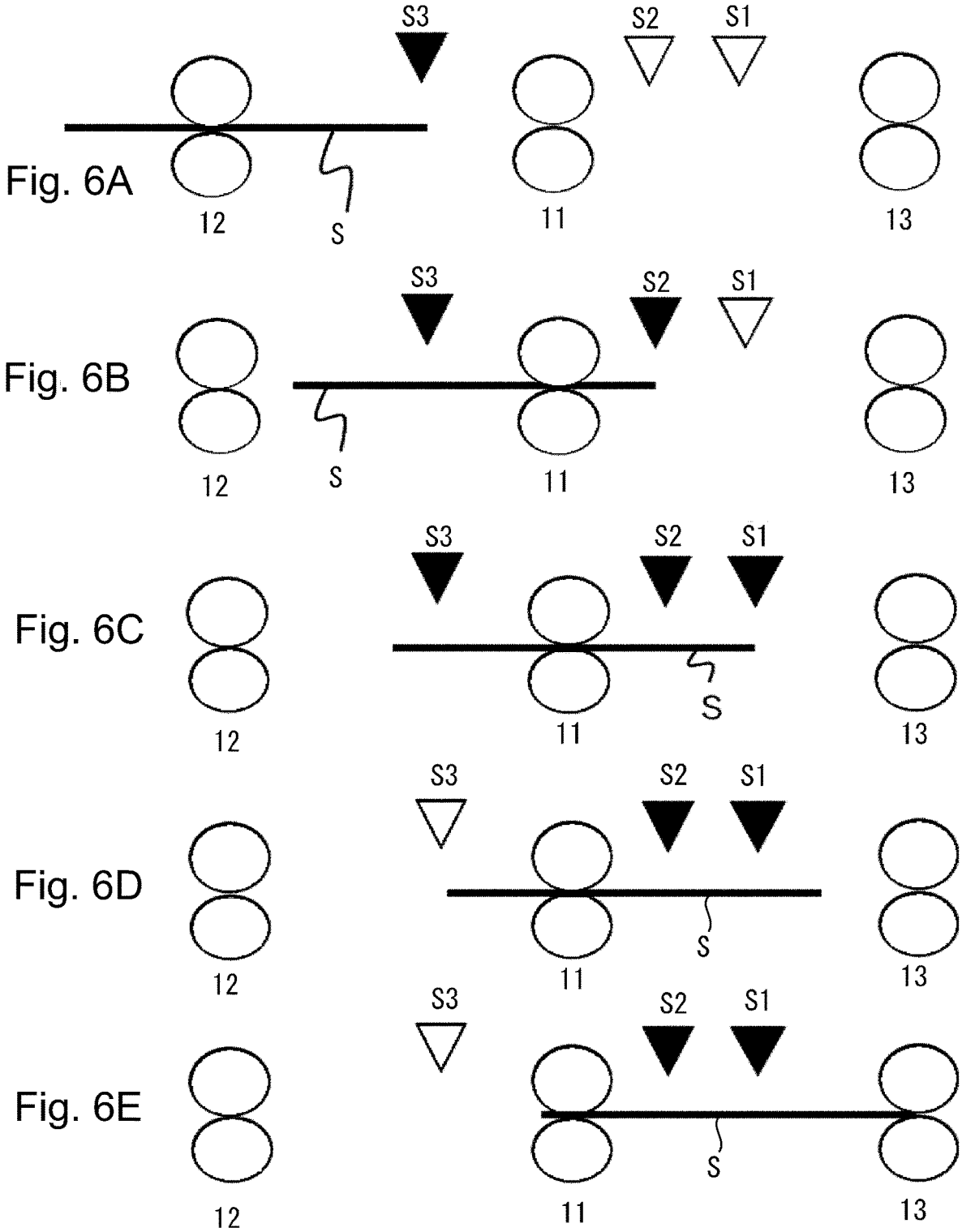
FIG. 6A to FIG. 6E are schematic views showing sheet feeding behavior of the sheet detecting unit in the embodiment 1.

Next, with reference to FIG. 6, sheet feeding behavior of the sheet detecting unit in this embodiment will be described. FIG. 6A is a schematic view in which the sheet with the sheet length L is nipped and fed by the upstream feeding roller pair 12. FIG. 6A shows a timing when the sheet leading end is detected by the second detecting portion S2. Incidentally, at this time, the trailing end of the sheet is in a state immediately after passing through the upstream feeding roller pair 12. Although described later, in order to calculate a speed of the sheet fed at this timing, measurement of a time is started (start timing of a first time). Further, in order to calculate the sheet length, measurement of a time is started (start timing of a second time). FIG. 6C is a schematic view in which the sheet is nipped and fed by the feeding roller pair 11. FIG. 6C shows a timing when the sheet leading end is detected by the first detecting portion S1 (start timing of a third time). Incidentally, at this time, the trailing end of the sheet is in a state after passing through the upstream feeding roller pair 12, and the third detecting portion S3 is in a state in which the third detecting portion S3 detects the sheet. Further, although described later, in order to calculate a speed of the sheet fed at this timing, the measurement of the time is ended (end timing of the first time). Further, in order to calculate the sheet length, measurement of a time is started. FIG. 6D is a schematic view in which the sheet is nipped and fed by the feeding roller pair 11. The sheet leading end is in a state before reaching the downstream feeding roller pair 13, and the sheet trailing end is in a state in which the sheet trailing end is detected by the third detecting portion S3. Further, although described later, in order to calculate the sheet length at this timing, with respect to the time when the measurement of the time in FIG. 6B and FIG. 6C is started, the measurement of the time is ended (end timings of the second time and the third time). FIG. 6E is a schematic view showing a timing when the sheet leading end is nipped by the downstream feeding roller pair 13. The sheet trailing end is in a state in which the sheet trailing end is nipped and fed by the feeding roller pair 11. As described above, the sheet detecting unit in this embodiment detects the leading end and the trailing end of the sheet while feeding the sheet.

Figure 7:
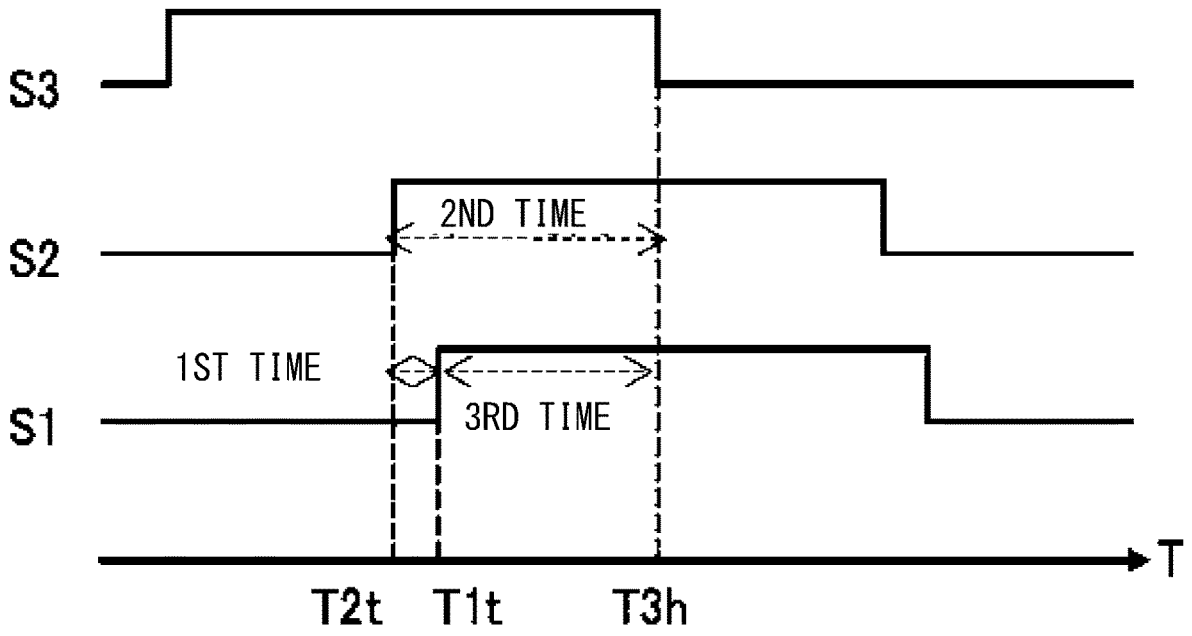
FIG. 7 is a time chart showing a change in signal in the sheet detecting unit in the embodiment 1.

Next, with reference to FIGS. 5, 6 and 7, a calculating method of the length of the sheet S with respect to the feeding direction D1 in this embodiment will be specifically described. FIG. 7 is a schematic view showing changes of signals outputted from the first detecting portion S1, the second detecting portion S2, and the third detecting portion S3, respectively, when the sheet surface passes through the sheet detecting unit 10 in FIGS. 5 and 6. In FIG. 7, timings when the leading end of the sheet S passes through the second detecting position P2 and the first detecting position P1 are indicated as T2*t* and T1*t*, respectively. Further, a timing when the trailing end of the sheet S passes through the third detecting position P3 is indicated as T3*h*. First, from the timings T2*t*, T1*t*, and T3*h* and relative positions between the first detecting position P1, the second detecting position P2, and the third detecting position P3 with respect to the feeding direction D1, the feeding speed V of the sheet S is calculated as represented by the following (formula 1-1):

$$\text{Feeding speed } V=L12/(T1t-T2t) \quad \text{(formula 1-1).}$$

In the (formula 1-1), the feeding speed V is calculated on the basis of the distance L12 and a difference between the timing T1*t* when the sheet leading end passes through the first detecting position P1 and the timing T2*t* when the sheet leading end passes through the second detecting position P2. The difference between the timing T1*t* when the sheet leading end passes through the first detecting position P1 and the timing T2*t* when the sheet leading end passes through the second detecting position P2 is the first time in this embodiment, and the distance L12 is a first distance in this embodiment.

Further, the lengths of the sheet with respect to the feeding direction D1 are calculated as represented by the following (formula 1-2):

$$\text{Length } L'=L23+(T3h-T2t)\times V,$$

$$\text{Length } L''=L23+L12+(T3h-T1t)\times V, \text{ and}$$

$$\text{Length } L=(L'+L'')/2 \quad \text{(formula 1-2).}$$

In the (formula 1-2), the length L' of the sheet with respect to the feeding direction D1 is calculated on the basis of the distance L23 and a difference between the timing T2*t* when the sheet leading end passes through the second detecting position P2 and the timing T3*h* when the sheet trailing end passes through the third detecting position P3. Further, the length L" of the sheet with respect to the feeding direction D1 is calculated on the basis of the distance (L23+L12) and the difference between the timing T1*t* when the sheet leading end passes through the first detecting position P1 and the timing T3*h* when the sheet trailing end passes through the third detecting position P3.

The difference between the timing T2*t* when the sheet leading end passes through the second detecting position P2 and the timing T3*h* when the sheet trailing end passes through the third detecting position P3 is the second time in this embodiment, and the distance L23 is a second distance in this embodiment.

Further, the difference between the timing T1*t* when the sheet leading end passes through the first detecting position P1 and the timing T3*h* when the sheet trailing end passes through the third detecting position P3 is the third time in this embodiment, and the distance (L23+L12) is a third distance in this embodiment.

In this embodiment, the sheet length L is calculated from an average of the length L' as a first length and the length L" as a second length in this embodiment. By this, a variation in detection of the end portion of the sheet S by the sensor of each of the first detecting portion S1, the second detecting portion S2, and the third detecting portion S3 is corrected, so that a calculation error of the sheet length can be made small. Accordingly, a constitution in which the sheet length L with respect to the feeding direction D1 is calculated on the basis of only one of the length L' and the length L" may also be employed. In this embodiment, for example, the feeding speed V of the sheet S calculated in the (formula 1-1) is substituted into the (formula 1-2), i.e., Length L"=L23+L12+(T3*h*−T1*t*)×V, and the sheet length L with respect to the feeding direction D1 may also be calculated in a condition of length L=length L".

Thus, in this embodiment, the length L is calculated using the sheet leading end passing timings (T2*t*, T1*t*) after the sheet leading end passes through the feeding roller pair 11 and using the sheet trailing end passing timing (T3*h*) before the sheet trailing end passes through the feeding roller pair 11. Accordingly, the length L of the sheet S with respect to the feeding direction D1 can be accurately calculated without being subjected to the influence when the sheet S enters the downstream feeding roller pair 13. That is, on the basis of the sheet length L, the sheet feeding timing by the oblique movement correcting portion is controlled, whereby it becomes possible to suppress the positional deviation of the images, formed on the sheet S, between the front and back sides.

Figure 8:
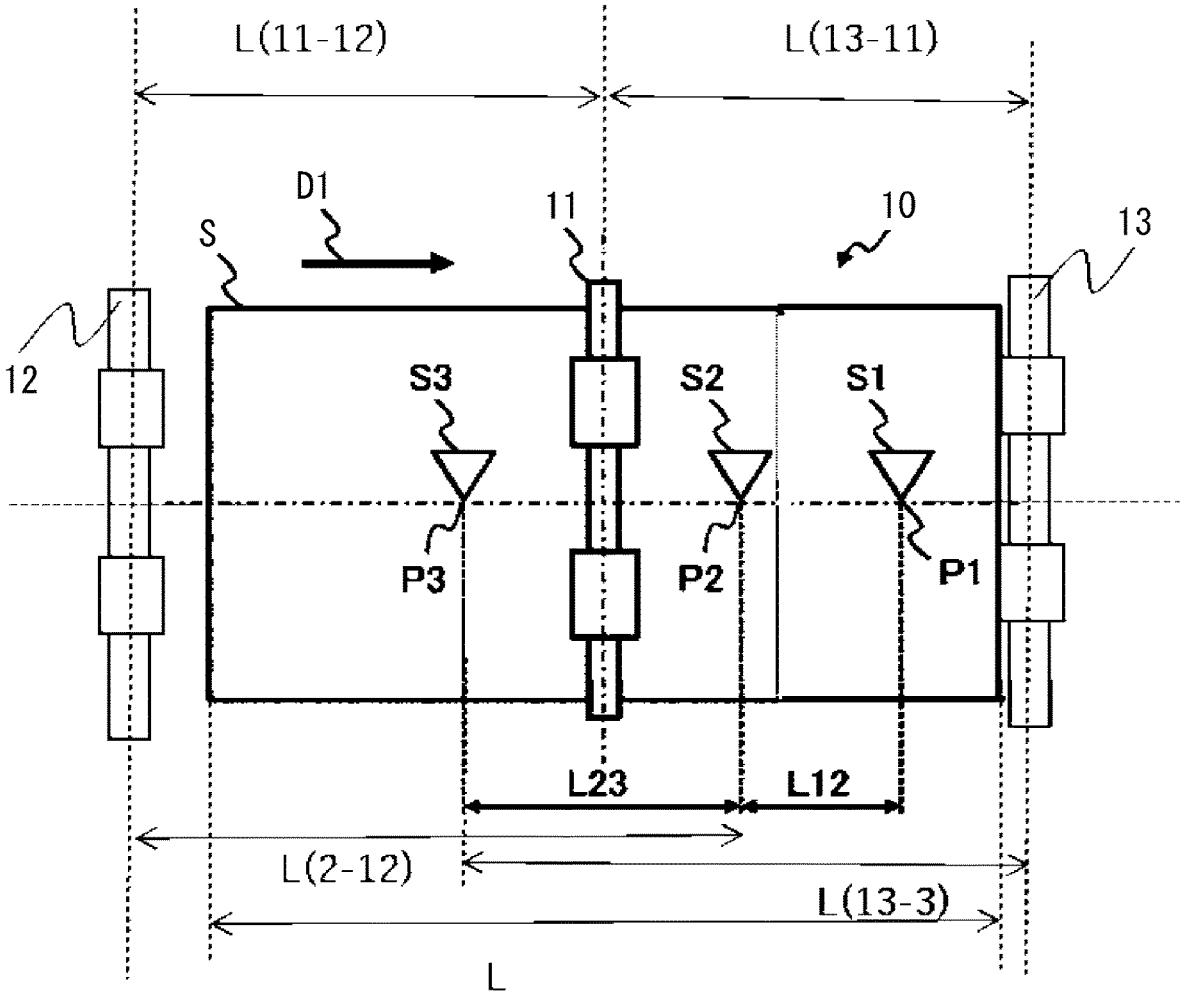
FIG. 8 is a top view showing a structure of a sheet detecting unit in a modified embodiment of the embodiment 1.

Next, a modified embodiment of the embodiment 1 is shown in FIGS. 8 and 9. As regards FIG. 8, a state in which the sheet trailing end is detected by the third detecting portion after the sheet leading end is nipped by the downstream feeding roller pair is assumed. That is, FIG. 8 shows the case where the sheet length L is made longer than the sheet length L in the embodiment 1 and where positional relationships each between the feeding roller pair and the detecting portion are set at the following formula (4)':

$$L(2-12)<L \text{ and } L(13-3)<L \qquad \text{formula (4)'.}$$

Figures 9A, 9B, 9C, 9D, 9E:
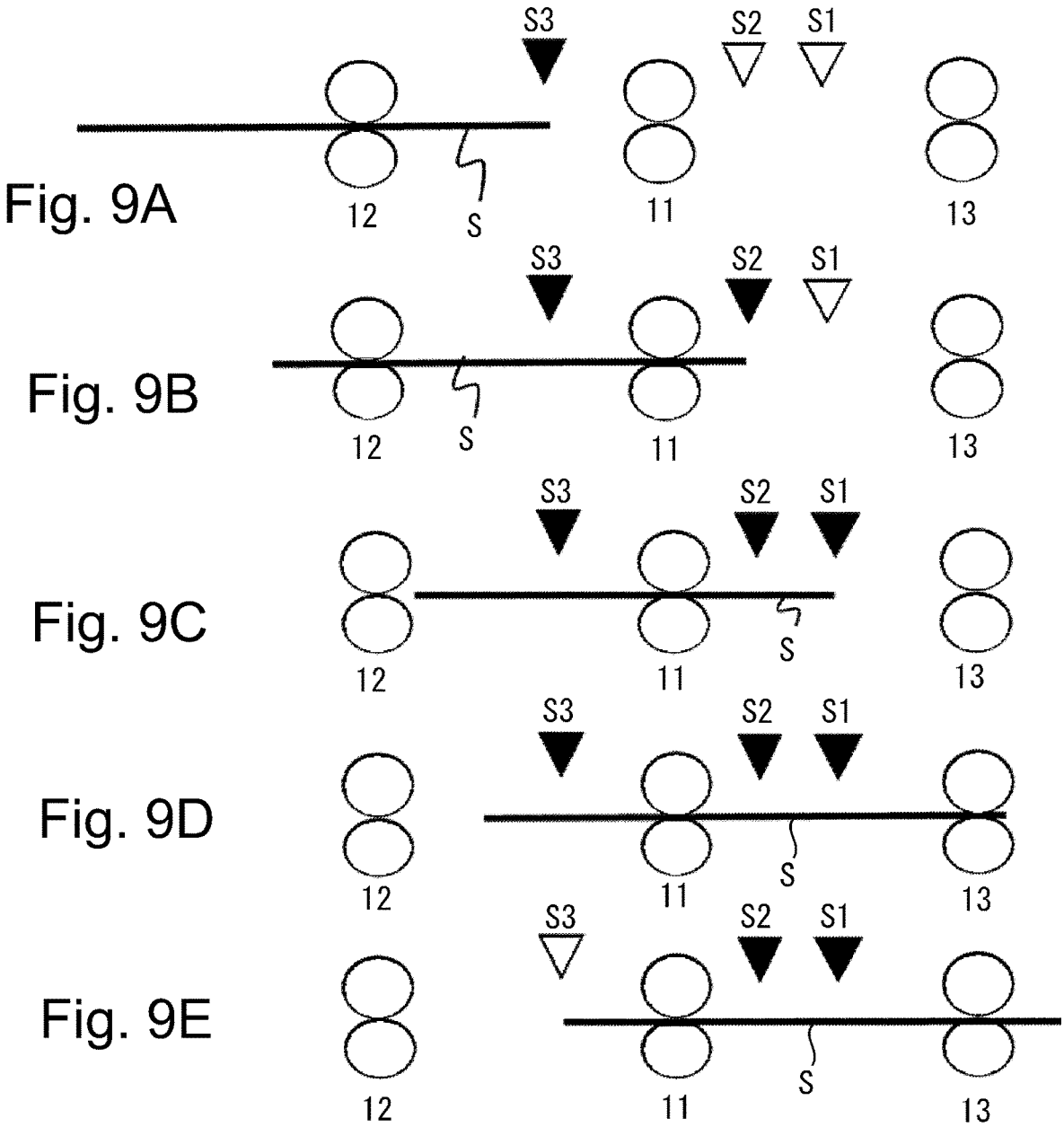
FIG. 9A to FIG. 9E are schematic views showing sheet feeding behavior of a sheet detecting unit in the modified embodiment of the embodiment 1.

As in the above-described embodiment 1, an arrangement in which the sheet trailing end is detected by the third detecting portion before the sheet leading end is nipped by the downstream feeding roller pair is made, so that shock such that the sheet leading end is nipped by the downstream feeding roller pair can be prevented reliably. However, even in the case where the positional detect as in the above-described formula (4)' in this modified embodiment is established, the length L of the sheet S can be accurately calculated for the following reason. FIG. 9 includes schematic views showing sheet feeding behavior of the sheet detecting unit in the arrangement of FIG. 8, and the sheet feeding behavior will be described using FIG. 9. FIG. 9A is a schematic view in which the sheet with the length L is nipped and fed by the upstream feeding roller pair 12. FIG. 9A shows a timing when the sheet leading end is detected by the third detecting portion S3. FIG. 9B is a schematic view in which the sheet is nipped and fed by the feeding roller pair 11. FIG. 9B shows a timing when the sheet leading end is detected by the second detecting portion S2. Incidentally, the sheet trailing end at this time is in a state in which the sheet trailing end is nipped by the upstream feeding roller pair 12. FIG. 9C is a schematic view in which the sheet is nipped and fed by the feeding roller pair 11. FIG. 9C shows a timing when the sheet leading end is detected by the first detecting portion S1. Incidentally, the sheet trailing end at this time is in a state in which the sheet trailing end is in a state after the sheet trailing end passes through the upstream feeding roller pair 12, and the third detecting portion S3 is in a state in which the third detecting portion S3 detects the sheet. In this modified embodiment, the sheet feeding speed is calculated at a timing when the sheet leading end passes through the second detecting portion and the first detecting portion. During passing of the sheet leading end through the second detecting portion, the sheet trailing end is in a state in which the sheet trailing end is in a state in which the sheet trailing end is nipped by the upstream feeding roller pair 12. Further, when the sheet leading end passes through the first detecting portion, the sheet trailing end is in a state in which the sheet trailing end passes the upstream feeding roller pair 12. In general, in the case where the number of the feeding roller pairs nipping the sheet changes, a variation in sheet feeding speed becomes large in some instances, but in this modified embodiment, the leading end portion of the sheet is nipped by the blasted-feeding roller pair 11, and therefore, the influence thereof is small. FIG. 9D is a schematic view of a timing when the sheet leading end reaches the downstream feeding roller pair 13. At this time, as described above, the sheet leading end receives shock from the downstream feeding roller pair 13. However, in this modified embodiment, the sheet trailing end is nipped by the feeding roller pair 11, and therefore, a positional deviation of the sheet does not readily occur on a side upstream of the feeding roller pair 11. Incidentally, as regards the sheet between the feeding roller pair 11 and the downstream feeding roller pair 13, the influence thereof is considered. FIG. 9E shows a timing when the sheet trailing end is detected by the third detecting portion. The sheet trailing end is detected by the third detecting portion in a state in which the sheet trailing end is nipped and fed by the feeding roller pair 11. That is, the sheet trailing end can be detected without being subjected to the influence of the shock when the sheet leading end enters the downstream feeding roller pair 13.

As described above, when the sheet leading end is nipped by the downstream feeding roller pair, the sheet is subjected to the shock, but the trailing end portion of the sheet is nipped by the feeding roller pair 11. In a state in which the trailing end portion of the sheet is nipped by the feeding roller pair 11, the sheet trailing end is detected by the third detecting portion. By that, as regards the shock received by the leading end of the sheet from the downstream feeding roller pair 13, the sheet trailing end is capable of being detected without being subjected to the shock. That is, the feeding speed and the length of the sheet fed are capable of being calculated with accuracy. Incidentally, in the case of the constitution in which the trailing end of the sheet is detected on a side downstream of the downstream feeding roller pair as in the conventional example, the sheet trailing end is detected in a state including the shock received by the sheet leading end from the downstream feeding roller pair 13, and therefore, it is natural that detection accuracy lowers,

Embodiment 2

<Constitution for Calculating Sheet Length with Respect to Feeding Direction in Embodiment 2>

Figure 10:
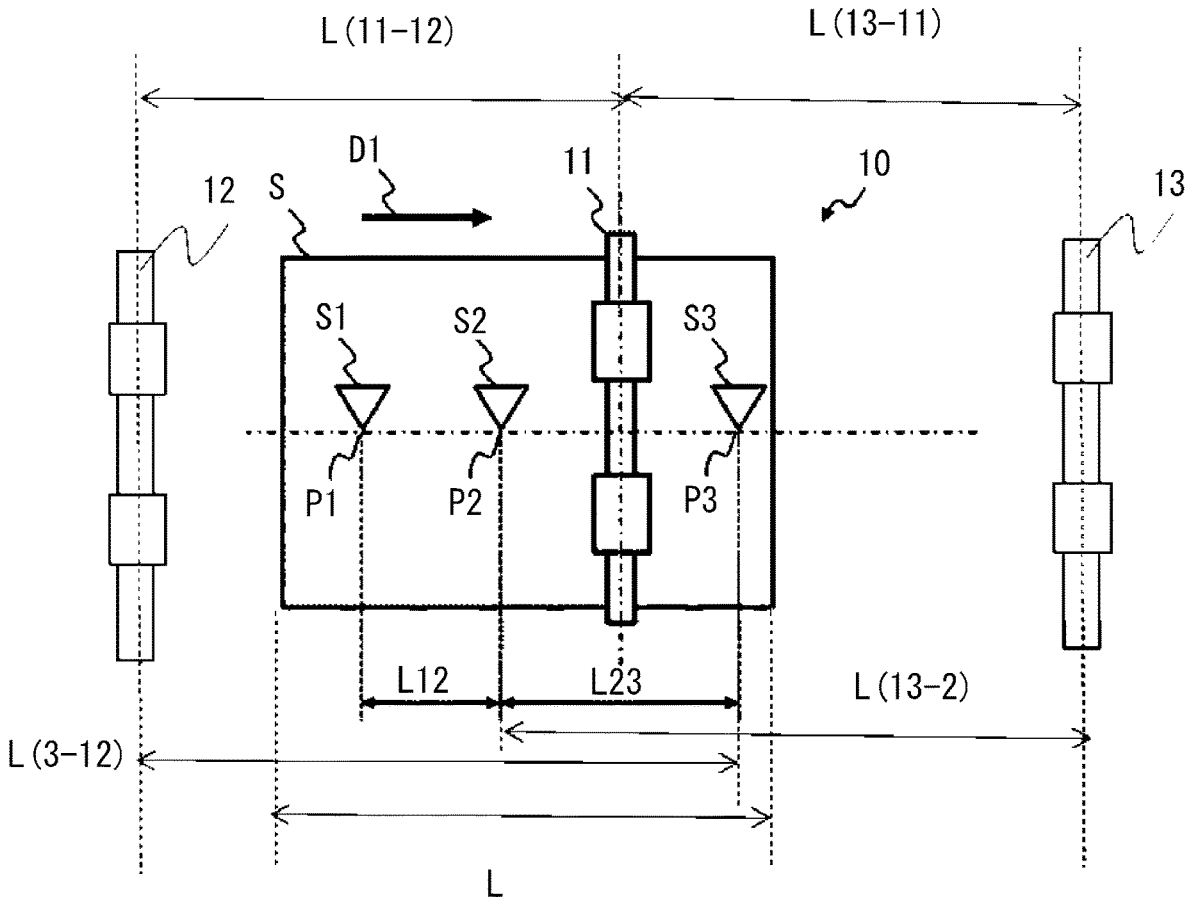
FIG. 10 is a top view showing a structure of a sheet detecting unit in an embodiment 2.

Next, a constitution for calculating the sheet length with respect to the feeding direction in the embodiment 2 will be described. FIG. 10 is a top (plan) view showing a structure of a sheet detecting unit 10 for calculating the sheet length with respect to the feeding direction in the embodiment 2.

A difference from the embodiment 1 is the number of detecting portions disposed on sides upstream and downstream of the feeding roller pair 11. Specifically, two detecting portions are disposed on a side upstream of the feeding roller pair 11 and downstream of the upstream feeding roller pair 12 and a single detecting portion is disposed on a side downstream of the feeding roller pair 11 and upstream of the downstream feeding roller pair 13. Incidentally, constitutions of the printer 1, the feeding roller pair 11, the upstream feeding roller pair 12, and the downstream feeding roller pair 13 are similar to those in the embodiment 1, and therefore, will be omitted from redundant description. As regards the sheet detecting unit 10, description will be made assuming that the sheet detecting unit 10 is disposed at a double-side feeding portion 502, but the sheet detecting unit 10 can also be disposed at a position other than the double-side feeding portion 502 when the sheet detecting unit 10 is on a feeding passage on which the sheet S is fed in the printer 1.

The sheet detecting unit 10 includes a feeding roller pair 11 for feeding the sheet S, and a first detecting portion S1, a second detecting portion S2, and a third detecting portion S3 which are used for detecting passing of end portions of the sheet S. With respect to the sheet feeding direction D1, the first detecting portion S1 and the second detecting portion S2 are disposed upstream of the feeding roller pair 11. With respect to the (sheet) feeding direction D1, the third detecting portion S3 is disposed downstream of the feeding roller pair 11.

The first detecting portion S1 detects the passing of the end portions of the sheet S at a first detecting position P1 on a side upstream of the feeding roller pair 11 and downstream of the upstream feeding roller pair 12 with respect to the feeding direction D1. Further, the second detecting portion S2 detects the passing of the end portions of the sheet S at a second detecting position P2 which is on a side upstream of the feeding roller pair 11 with respect to the feeding direction D1 and which is different from the first detecting position P1. Further, the third detecting portion S3 detects the end portions of the sheet S at a third detecting position P3 on a side downstream of the feeding roller pair 11 and upstream of the downstream feeding roller pair 13 with respect to the feeding direction D1. In FIG. 8, an example in which each of the first detecting position P1, the second detecting position P2, and the third detecting position P3 is detected at a center of the sheet S with respect to a widthwise direction perpendicular to the feeding direction D1 is shown.

Further, in FIG. 8, a distance between the first detecting position P1 and the second detecting position P2 with respect to the feeding direction D1 is indicated as L12, and a distance between the second detecting position P2 and the third detecting position P3 with respect to the feeding direction D1 is indicated as L23. Incidentally, the first detecting portion S1 is constituted by including an optical sensor which outputs a Low signal in the case where the sheet S is not present and which outputs a High signal in the case where the sheet S is present. Also, as regards the second detecting portion S2 and the third detecting portion S3, the same sensor as the first detecting portion S1 is used. Accordingly, by passing of the leading end of the sheet S, the signal outputted from the sensor of each of the first detecting portion S1, the second detecting portion S2, and the third detecting portion S3 is switched from Low to High. Further, by passing of the trailing end of the sheet S, the signal outputted from the sensor of each of the first detecting portion S1, the second detecting portion S2, and the third detecting portion S3 is switched from High to Low. Accordingly, the controller 9 is capable of recognizing passing timings of the leading end or the trailing end of the sheet at the first detecting position P1, the second detecting position P2, and the third detecting position P3 in response to signals outputted from the sensors of the first detecting portion S1, the second detecting portion S2, and the third detecting portion S3, respectively. Further, the controller 9 is capable of calculating the feeding speed V of the sheet S and the length of the sheet S with respect to the feeding direction D1 on the basis of passing timings of the leading end or the trailing end of the sheet S at the first detecting position P1, the second detecting position P2, and the third detecting position P3. Further, in the case where the length of the sheet S is L, a length between the feeding roller pair 11 and the upstream feeding roller pair 12 is L (11–12), a length between the downstream feeding roller pair 13 and the feeding roller pair 11 is L (13–11), a length between the third detecting portion S3 and the upstream feeding roller pair 12 is L (3–12), and a length between the downstream feeding roller pair 13 and the second detecting portion S2 is a L (13–2), the feeding roller pairs and the detecting portions are detected so as to satisfy the following relationships:

$$L>L(11-12) \text{ and } L>L(13-11) \quad \text{formula (5)}$$

$$L(3-12)>L \text{ and } L(13-2)>L \quad \text{formula (6)}$$

As regards the respective feeding roller pairs and the respective detecting portions, by disposing the feeding roller pairs and the detecting portions so as to satisfy the relationships of the formula (5) and the formula (6), the sheet detecting unit 10 is capable of detecting the leading end and the trailing end of the sheet S by the first detecting portion, the second detecting portion, and the third detecting portion in a state in which the sheet S is not nipped by the upstream feeding roller pair and the downstream feeding roller pair during feeding of the sheet S by the feeding roller pair 11. That is, when the sheet length is calculated, it becomes possible to calculate the sheet length before the leading end of the sheet is nipped by the downstream feeding roller pair. That is, vibration of the sheet due to the nipping of the leading end of the sheet by the downstream feeding roller pair can be suppressed, so that it becomes possible to detect the sheet length with accuracy.

Figure 11:
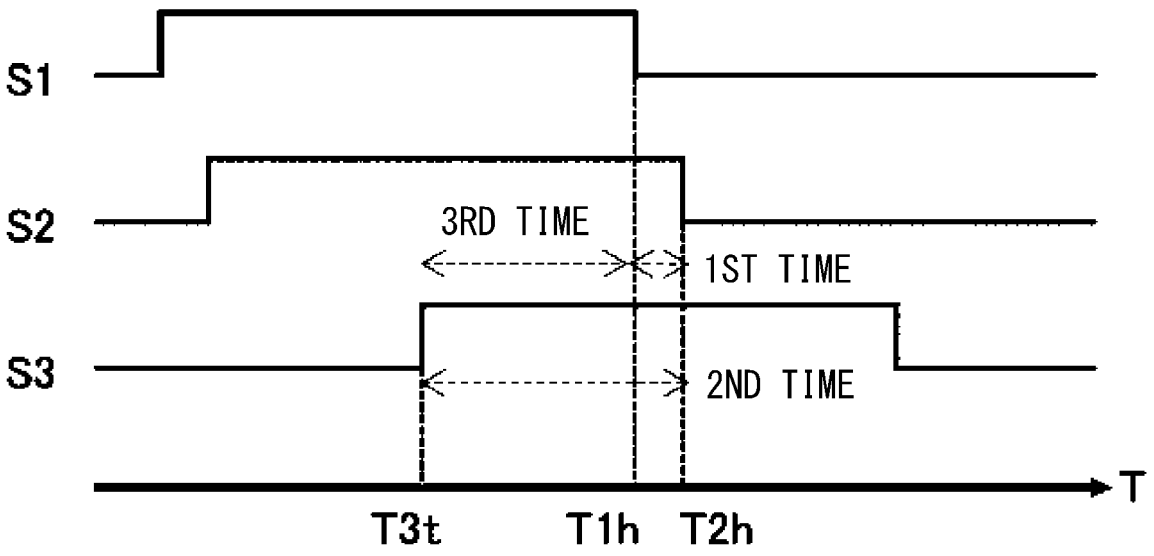
FIG. 11 is a time chart showing a change in signal in the sheet detecting unit in the embodiment 2.

Next, with reference to FIGS. 10 and 11, a calculating method of the length of the sheet S with respect to the feeding direction D1 in this embodiment will be described. FIG. 11 is a schematic view showing changes of signals outputted from the first detecting portion S1, the second detecting portion S2, and the third detecting portion S3, respectively, when the sheet surface passes through the sheet detecting unit 10 in FIG. 10. In FIG. 11, timings when the trailing end of the sheet S passes through the first detecting position P1 and the second detecting position P2 are indicated as T1*h* and T2*h*, respectively. Further, a timing when the leading end of the sheet S passes through the third detecting position P3 is indicated as T3*t*. First, from the timings T1*h*, T2*h*, and T3*t* and relative positions between the first detecting position P1, the second detecting position P2, and the third detecting position P3 with respect to the feeding direction D1, the feeding speed V of the sheet S is calculated as represented by the following (formula 2-1):

$$\text{Feeding speed } V=L12/(T2h-T1h) \quad \text{(formula 2-1).}$$

In the (formula 2-1), the feeding speed V is calculated on the basis of the distance L12 and a difference between the timing T1*h* when the sheet trailing end passes through the first detecting position P1 and the timing T2*f* when the sheet trailing end passes through the second detecting position P2. The difference between the timing T1*h* when the sheet trailing end passes through the first detecting position P1 and the timing T2*h* when the sheet trailing end passes through the second detecting position P2 is the first time in this embodiment, and the distance L12 is a first distance in this embodiment.

Further, the lengths of the sheet with respect to the feeding direction D1 are calculated as represented by the following (formula 2-2):

$$\text{Length } L'=L12+L23+(T1h-T3t)\times V,$$

$$\text{Length } L''=L23+(T2h-T3t)\times V, \text{ and}$$

$$\text{Length } L=(L'+L'')/2 \quad \text{(formula 2-2).}$$

In the (formula 2-2), the length L' of the sheet with respect to the feeding direction D1 is calculated on the basis of the distance (L23+L12) and a difference between the timing T1*h* when the sheet trailing end passes through the first detecting position P1 and the timing T3*t* when the sheet leading end passes through the third detecting position P3. Further, the length L" of the sheet with respect to the feeding direction D1 is calculated on the basis of the distance L23 and the difference between the timing T2*h* when the sheet trailing end passes through the second detecting position P2 and the timing T3*t* when the sheet leading end passes through the third detecting position P3.

The difference between the timing T1*h* when the sheet trailing end passes through the first detecting position P1 and the timing T3*t* when the sheet leading end passes through the third detecting position P3 is the third time in this embodiment, and the distance (L23+L12) is a third distance in this embodiment.

Further, the difference between the timing T2*h* when the sheet trailing end passes through the second detecting position P2 and the timing T3*t* when the sheet leading end passes through the third detecting position P3 is the second time in this embodiment, and the distance L23 is a second distance in this embodiment.

In this embodiment, the sheet length L is calculated from an average of the length L' as a first length and the length L" as a second length in this embodiment. By this, a variation in detection of the end portion of the sheet S by the sensor of each of the first detecting portion S1, the second detecting portion S2, and the third detecting portion S3 is corrected, so that a calculation error of the sheet length can be made small. Accordingly, a constitution in which the sheet length L with respect to the feeding direction D1 is calculated on the basis of only one of the length L' and the length L" may also be employed. In this embodiment, for example, the feeding speed V of the sheet S calculated in the (formula 2-1) is substituted into the (formula 2-2), i.e., Length L'=L12+L23+(T1*h*−T3*t*)×V, and the sheet length L with respect to the feeding direction D1 may also be calculated in a condition of length L=length L'.

Thus, in this embodiment, the length L is calculated using the sheet trailing end passing timings (times T1*h*, T2*h*) before the sheet leading end passes through the feeding roller pair 11 and using the sheet trailing end passing timing (time T3*t*) after the sheet leading end passes through the feeding roller pair 11. Accordingly, the length L of the sheet S with respect to the feeding direction D1 can be accurately calculated without being subjected to the influence when the sheet S enters the downstream feeding roller pair 13. That is, on the basis of the sheet length L, the sheet feeding timing by the oblique movement correcting portion is controlled, whereby it becomes possible to suppress the positional deviation of the images, formed on the sheet S, between the front and back sides. Incidentally, also, as regards the embodiment 2, as a modified embodiment, a constitution similar to the constitution of the modified embodiment of the embodiment 1 may also be employed. That is, after the leading end of the sheet is nipped by the downstream feeding roller pair 13, the trailing end of the sheet may also be detected by the second detecting portion.

Embodiment 3

<Constitution for Calculating Sheet Length with Respect to Feeding Direction in Embodiment 3>

Figure 12:
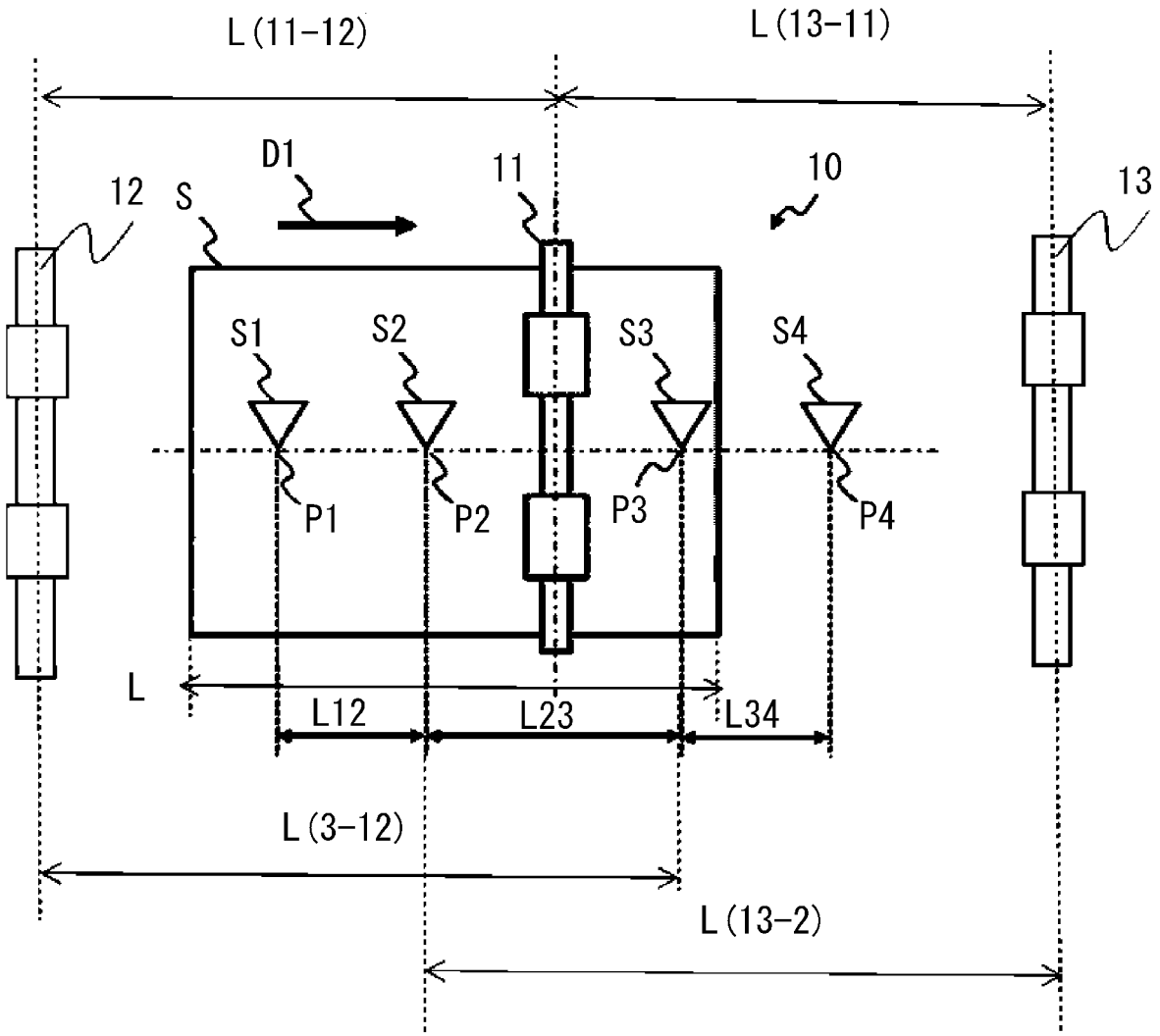
FIG. 12 is a top view showing a structure of a sheet detecting unit in an embodiment 3.

Next, a constitution for calculating the sheet length with respect to the feeding direction in the embodiment 3 will be described. FIG. 12 is a top (plan) view showing a structure of a sheet detecting unit 10 for calculating the sheet length with respect to the feeding direction in the embodiment 3.

A difference from the embodiments 1 and 2 is the number of detecting portions disposed on sides upstream and downstream of the feeding roller pair 11. Specifically, two detecting portions are disposed on a side upstream of the feeding roller pair 11 and downstream of the upstream feeding roller pair 12 and two detecting portions are disposed on a side downstream of the feeding roller pair 11 and upstream of the downstream feeding roller pair 13. Incidentally, constitutions of the printer 1, the feeding roller pair 11, the upstream feeding roller pair 12, and the downstream feeding roller pair 13 are similar to those in the embodiment 1, and therefore, will be omitted from redundant description. As regards the sheet detecting unit 10, description will be made assuming that the sheet detecting unit 10 is disposed at a double-side feeding portion 502, but the sheet detecting unit 10 can also be disposed at a position other than the double-side feeding portion 502 when the sheet detecting unit 10 is on a feeding passage on which the sheet S is fed in the printer 1.

The sheet detecting unit 10 includes a feeding roller pair 11 for feeding the sheet S, and a first detecting portion S1, a second detecting portion S2, a third detecting portion S3, and a fourth detecting portion S4 which are used for detecting passing of end portions of the sheet S. With respect to the sheet feeding direction D1, the first detecting portion S1 and the second detecting portion S2 are disposed upstream of the feeding roller pair 11. With respect to the (sheet) feeding direction D1, the third detecting portion S3 and the fourth detecting portion S4 are disposed downstream of the feeding roller pair 11.

The first detecting portion S1 detects the passing of the end portions of the sheet S at a first detecting position P1 on a side upstream of the feeding roller pair 11 and downstream of the upstream feeding roller pair 12 with respect to the feeding direction D1. Further, the second detecting portion S2 detects the passing of the end portions of the sheet S at a second detecting position P2 which is on a side upstream of the feeding roller pair 11 with respect to the feeding direction D1 and which is different from the first detecting position P1. Further, the third detecting portion S3 detects the end portions of the sheet S at a third detecting position P3 on a side downstream of the feeding roller pair 11 and upstream of the downstream feeding roller pair 13 with respect to the feeding direction D1. The fourth detecting portion S4 detects passing of the end portions of the sheet at a fourth detecting position P4 which is on a side downstream of the feeding roller pair 11 with respect to the feeding direction D1 and which is different from the third detecting position P3. In FIG. 10, an example in which each of the first detecting position P1, the second detecting position P2, the third detecting position P3, and the fourth detecting portion P4 is detected at a center of the sheet S with respect to a widthwise direction perpendicular to the feeding direction D1 is shown.

Further, in FIG. 12, a distance between the first detecting position P1 and the second detecting position P2 with respect to the feeding direction D1 is indicated as L12, a distance between the second detecting position P2 and the third detecting position P3 with respect to the feeding direction D1 is indicated as L23, and a distance between the third detecting position P3 and the fourth detecting position P4 with respect to the feeding direction D1 is indicated as L34. Further, the first detecting portion S1 is constituted by including an optical sensor which outputs a Low signal in the case where the sheet S is not present and which outputs a High signal in the case where the sheet S is present. Also, as regards the second detecting portion S2, the third detecting portion S3, and the fourth detecting portion S4, the same sensor as the first detecting portion S1 is used. Accordingly, by passing of the leading end of the sheet S, the signal outputted from the sensor of each of the first detecting portion S1, the second detecting portion S2, and the third detecting portion S3, and the fourth detecting portion S4 is switched from Low to High. Further, by passing of the trailing end of the sheet S, the signal outputted from the sensor of each of the first detecting portion S1, the second detecting portion S2, and the third detecting portion S3, and the fourth detecting portion S4 is switched from High to Low. Accordingly, the controller 9 is capable of recognizing a passing timing of the leading end or the trailing end of the sheet at the first detecting position P1 in response to a signal outputted from the sensors of the first detecting portion S1. Incidentally, also, as regards the second detecting portion S2, the third detecting portion S3, and the fourth detecting portion S4, similarly as the first detecting portion S1, the controller 9 is capable of recognizing passing timings of the leading end or the trailing end of the sheet at the second detecting position P2, the third detecting position P3, and the fourth detecting position P4. Further, the controller 9 is capable of calculating the feeding speed V of the sheet S and the length of the sheet S with respect to the feeding direction D1 on the basis of passing timings of the leading end or the trailing end of the sheet S at the first detecting position P1, the second detecting position P2, the third detecting position P3, and the fourth detecting position P4. Further, in the case where the length of the sheet S is L, a length between the feeding roller pair 11 and the upstream feeding roller pair 12 is L (11−12), a length between the downstream feeding roller pair 13 and the feeding roller pair 11 is L (13−11), a length between the third detecting portion S3 and the upstream feeding roller pair 12 is L (3−12), and a length between the downstream feeding roller pair 13 and the second detecting portion S2 is a L(13−2), the feeding roller pairs and the detecting portions are detected so as to satisfy the following relationships:

$$L>L(11-12) \text{ and } L>L(13-11) \quad \text{formula (7)}$$

$$L(3-12)>L \text{ and } L(13-2)>L \quad \text{formula (8)}$$

As regards the respective feeding roller pairs and the respective detecting portions, by disposing the feeding roller pairs and the detecting portions so as to satisfy the relationships of the formula (7) and the formula (8), the sheet detecting unit 10 is capable of detecting the leading end and the trailing end of the sheet S by the first detecting portion, the second detecting portion, the third detecting portion, and the fourth detecting portion in a state in which the sheet S is not nipped by the upstream feeding roller pair and the downstream feeding roller pair during feeding of the sheet S by the feeding roller pair 11. That is, when the sheet length is calculated, it becomes possible to calculate the sheet length before the leading end of the sheet is nipped by the downstream feeding roller pair. That is, vibration of the sheet due to the nipping of the leading end of the sheet by the downstream feeding roller pair can be suppressed, so that it becomes possible to detect the sheet length with accuracy.

Figure 13:
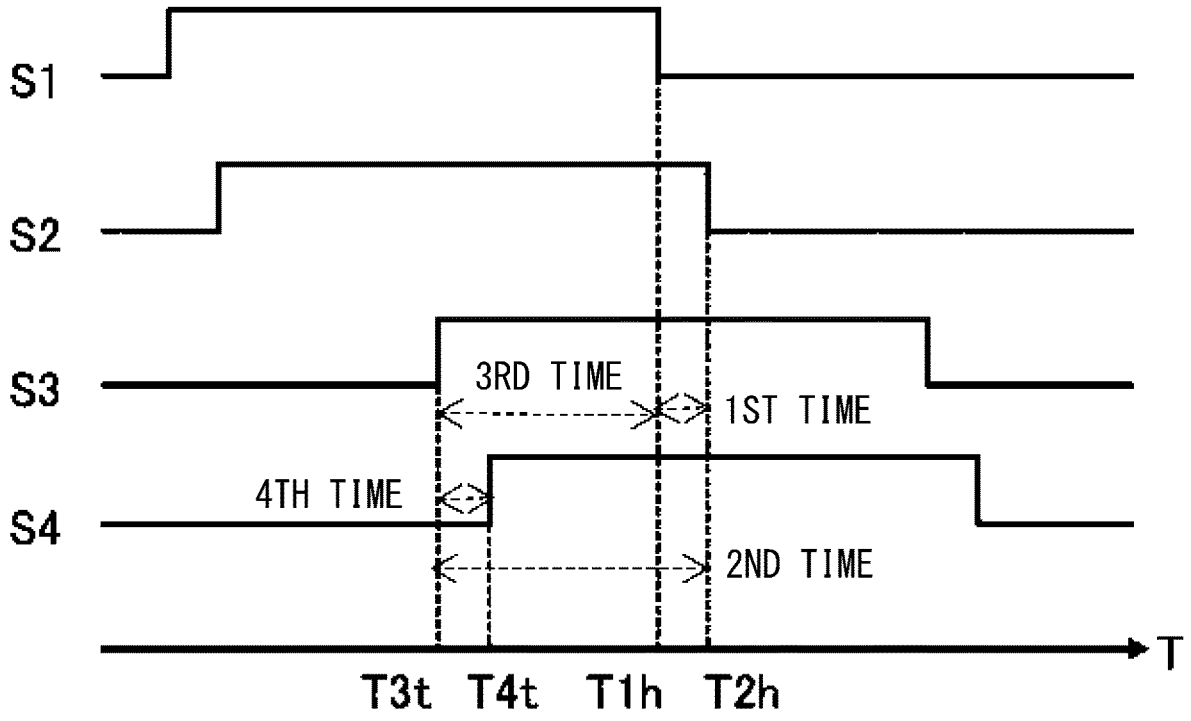
FIG. 13 is a time chart showing a change in signal in the sheet detecting unit in the embodiment 3.

Next, with reference to FIGS. 12 and 13, a calculating method of the length of the sheet S with respect to the feeding direction D1 in this embodiment will be described. FIG. 13 is a schematic view showing changes of signals outputted from the first detecting portion S1, the second detecting portion S2, the third detecting portion S3, and the fourth detecting portion S4, respectively, when the sheet surface passes through the sheet detecting unit 10 in FIG. 12. In FIG. 10, timings when the trailing end of the sheet S passes through the first detecting position P1 and the second detecting position P2 are indicated as T1*h* and T2*h*, respectively. Further, a timing when the leading end of the sheet S passes through the third detecting position P3 and the fourth detecting position P4 are indicated as T3*t* and T4*t*, respectively. First, from the timings T1*h*, T2*h*, T3*t*, and T4*t* and relative positions between the first detecting position P1, the second detecting position P2, the third detecting position P3, and the fourth detecting position P4 with respect to the feeding direction D1, the feeding speed V of the sheet S is calculated as represented by the following (formula 3-1):

$$\text{Feeding speed } V=L34/(T4t-T3t)$$

$$\text{Feeding speed } V''=L12/(T2h-T1h)$$

$$\text{Feeding speed } V=(V+V'')/2 \quad \text{(formula 3-1).}$$

In the (formula 3-1), the feeding speed V" as a first speed in this embodiment is calculated on the basis of the distance L12 and a difference between the timing T1*h* when the sheet trailing end passes through the first detecting position P1 and the timing T2*f* when the sheet trailing end passes through the second detecting position P2. The difference between the timing T1*h* when the sheet trailing end passes through the first detecting position P1 and the timing T2*h* when the sheet trailing end passes through the second detecting position P2 is the first time in this embodiment, and the distance L12 is a first distance in this embodiment. A difference between the timing T3*t* when the sheet leading end passes through the third detecting position P3 and the timing T4*t* when the sheet leading end passes through the fourth detecting position P4 is a fourth time in this embodiment, and the distance L34 is a fourth distance in this embodiment.

Further, in the (formula 3-1), the speed V as a second speed in this embodiment is calculated on the basis of the distance L34 and the difference between the timing T3*t* when the sheet leading end passes through the third detecting position P3 and the timing T4*t* when the sheet leading end passes through the fourth detecting position P4. Here, by calculating the feeding speed V from an average of the speed V' and the speed V", a calculation error due to a variation in detection of the end portion of the sheet S by the sensor of each of the first detecting portion S1, the second detecting portion S2, the third detecting portion S3, and the fourth detecting portion S4 can be made small.

Further, the lengths of the sheet with respect to the feeding direction D1 are calculated as represented by the following (formula 3-2):

$$\text{Length } L'=L12+L23+L34+(T1h-T4t)\times V,$$

$$\text{Length } L''=L12+L23+(T1h-T3t)\times V,$$

$$\text{Length } L'''=L23+L34+(T2h-T4t)\times V,$$

$$\text{Length } L''''=L23+(T2h-T3t)\times V, \text{ and}$$

$$\text{Length } L=(L'+L''+L'''+L'''')/4 \qquad \text{(formula 3-2).}$$

In the (formula 3-2), the length L' of the sheet with respect to the feeding direction D1 is calculated on the basis of the distance (L12+L23+L34) and a difference between the timing T1*h* when the sheet trailing end passes through the first detecting position P1 and the timing T4*t* when the sheet leading end passes through the fourth detecting position P4. Further, the length L" of the sheet with respect to the feeding direction D1 is calculated on the basis of the distance (L12+L23) and the difference between the timing T1*h* when the sheet trailing end passes through the first detecting position P1 and the timing T3*t* when the sheet leading end passes through the third detecting position P3. Further, the length L''' of the sheet with respect to the feeding direction D1 is calculated on the basis of the distance (L23+L34) and the difference between the timing T2*h* when the sheet trailing end passes through the second detecting position P2 and the timing T4*t* when the sheet leading end passes through the fourth detecting position P4. Further, the length L'''' of the sheet with respect to the feeding direction D1 is calculated on the basis of the distance L23 and the difference between the timing T2*h* when the sheet trailing end passes through the second detecting position P2 and the timing T3*t* when the sheet leading end passes through the third detecting position P3.

The difference between the timing T1*h* when the sheet trailing end passes through the first detecting position P1 and the timing T3*t* when the sheet leading end passes through the third detecting position P3 is the third time in this embodiment, and the distance (L23+L12) is a third distance in this embodiment.

Further, the difference between the timing T2*h* when the sheet trailing end passes through the second detecting position P2 and the timing T3*t* when the sheet leading end passes through the third detecting position P3 is the second time in this embodiment, and the distance L23 is a second distance in this embodiment.

Here, the sheet length L is calculated from an average of the length L' as a first length and the length L" as a second length in this embodiment, the length L''', and the length L". By this, a calculation error of the sheet length due to a variation in detection of the end portion of the sheet S by the sensor of each of the first detecting portion S1, the second detecting portion S2, and the third detecting portion S3, and the fourth detecting portion S4 can be made small. Incidentally, a constitution in which the sheet length L with respect to the feeding direction D1 is calculated on the basis of only one of the length L' and the length L" or an average of either two or more of the length L', the length L", the length L''', and the length L" may also be employed. In this embodiment, for example, the feeding speed V of the sheet S calculated in the (formula 3-1) is substituted into the (formula 3-2), i.e., Length L"=L12+L23+(T1*h*−T3*t*)×V, and the sheet length L with respect to the feeding direction D1 may also be calculated in a condition of length L=length L".

Thus, in this embodiment, the length L is calculated using the sheet trailing end passing timings (T1*h*, T2*h*) before the sheet trailing end passes through the feeding roller pair 11 and using the sheet leading end passing timing (T3*t*, T4*t*) after the sheet leading end passes through the feeding roller pair 11. Accordingly, the length L of the sheet S with respect to the feeding direction D1 can be accurately calculated without being subjected to the influence when the sheet S enters the downstream feeding roller pair 13. That is, on the basis of the sheet length L, the sheet feeding timing by the oblique movement correcting portion is controlled, whereby it becomes possible to suppress the positional deviation of the images, formed on the sheet S, between the front and back sides. Incidentally, also, as regards the embodiment 3, as a modified embodiment, a constitution similar to the constitution of the modified embodiments of the embodiments 1 and 2 may also be employed. That is, after the leading end of the sheet is nipped by the downstream feeding roller pair 13, the trailing end of the sheet may also be detected by the second detecting portion.

Embodiment 4

<Constitution for Calculating Sheet Length with Respect to Feeding Direction in Embodiment 4>

Figure 14:
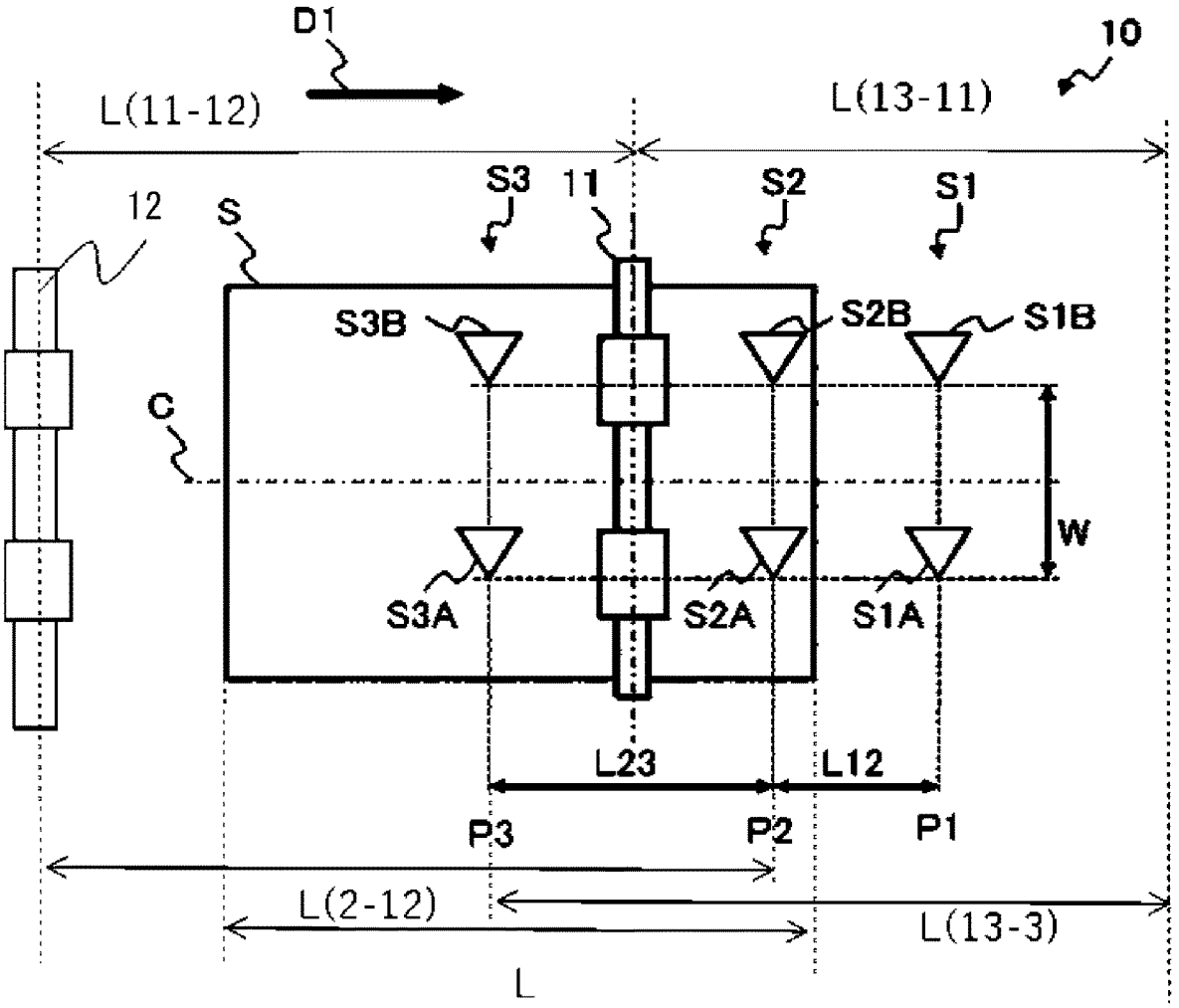
FIG. 14 is a top view showing a structure of a sheet detecting unit in an FIG. 4.

Next, a constitution for calculating the sheet length with respect to the feeding direction in the embodiment 4 will be described. FIG. 14 is a top (plan) view showing a structure of a sheet detecting unit 10 for calculating the sheet length with respect to the feeding direction in the embodiment 4.

A difference from the embodiments 1, 2 and 3 is that each of detecting portions disposed on sides upstream and downstream of the feeding roller pair 11 is provided with a plurality of sensors with respect to the widthwise direction. Incidentally, constitutions of the printer 1, the feeding roller pair 11, the upstream feeding roller pair 12, the downstream feeding roller pair 13, the first detecting portion S1, the second detecting portion S2, and the third detecting portion S3 are similar to those in the embodiment 1, and therefore, will be omitted from redundant description. As regards the sheet detecting unit 10, description will be made assuming that the sheet detecting unit 10 is disposed at a double-side feeding portion 502, but the sheet detecting unit 10 can also be disposed at a position other than the double-side feeding portion 502 when the sheet detecting unit 10 is on a feeding passage on which the sheet S is fed in the printer 1.

The first detecting portion S1 includes sensors S1A and S1B for detecting the passing of the end portion of the sheet at the first detecting position P1 on a side downstream of the feeding roller pair 11 and upstream of the downstream feeding roller pair 13 with respect to the feeding direction D1. The sensors S1A and S1B are a pair of sensors disposed with an interval with respect to the widthwise direction perpendicular to the feeding direction D1. Further, the second detecting portion S2 includes sensors S2A and S2B for detecting the passing of the end portion of the sheet at the second detecting position P2 which is on a side downstream of the feeding roller pair 11 with respect to the feeding direction D1 and which is different from the first detecting position P1. The sensors S2A and S2B are a pair of sensors disposed with an interval with respect to the widthwise direction perpendicular to the feeding direction D1. Further, the third detecting portion S3 includes sensors S3A and S3B for detecting the passing of the end portion of the sheet at the third detecting position P3 on a side upstream of the feeding roller pair 11 and downstream of the upstream feeding roller pair 12 with respect to the feeding direction D1. The sensors S3A and S3B are a pair of sensors disposed with an interval with respect to the widthwise direction perpendicular to the feeding direction D1.

Incidentally, in FIG. 14, a distance between the first detecting position P1 and the second detecting position P2 with respect to the feeding direction D1 is indicated as L12, and a distance between the second detecting position P2 and the third detecting position P3 with respect to the feeding direction D1 is indicated as L23. Further, each of the sensors S1A and S1B constituting the first detecting portion S1 is an optical sensor which outputs a Low signal in the case where the sheet S is not present and which outputs a High signal in the case where the sheet S is present. Also, as regards the second detecting portion S2 and the third detecting portion S3, the same sensor as the first detecting portion S1 is used. Accordingly, by passing of the leading end of the sheet S, the signal outputted from each of the first detecting portion S1, the second detecting portion S2, and the third detecting portion S3 is switched from Low to High. Further, by passing of the trailing end of the sheet S, the signal outputted from each of the first detecting portion S1, the second detecting portion S2, and the third detecting portion S3 is switched from High to Low. Accordingly, the controller 9 is capable of recognizing passing timings of the leading end or the trailing end of the sheet at the first detecting position P1, the second detecting position P2, and the third detecting position P3 in response to signals outputted from the first detecting portion S1, the second detecting portion S2, and the third detecting portion S3, respectively. Further, the controller 9 is capable of calculating the feeding speed V of the sheet S and the length of the sheet S with respect to the feeding direction D1 on the basis of passing timings of the leading end or the trailing end of the sheet S at the first detecting position P1, the second detecting position P2, and the third detecting position P3. Further, in the case where the length of the sheet S is L, a length between the feeding roller pair 11 and the upstream feeding roller pair 12 is L (11−12), a length between the downstream feeding roller pair 13 and the feeding roller pair 11 is L (13−11), a length between the second detecting portion S2 and the upstream feeding roller pair 12 is L (2−12), and a length between the downstream feeding roller pair 13 and the third detecting portion S3 is a L (13−3), the feeding roller pairs and the detecting portions are detected so as to satisfy the following relationships:

$$L>L(11-12) \text{ and } L>L(13-11) \quad \text{formula (9)}$$

$$L(2-12)>L \text{ and } L(13-3)>L \quad \text{formula (10)}$$

As regards the respective feeding roller pairs and the respective detecting portions, by disposing the feeding roller pairs and the detecting portions so as to satisfy the relationships of the formula (9) and the formula (10), the sheet detecting unit 10 is capable of detecting the leading end and the trailing end of the sheet S by the first detecting portion, the second detecting portion, and the third detecting portion in a state in which the sheet S is not nipped by the upstream feeding roller pair and the downstream feeding roller pair during feeding of the sheet S by the feeding roller pair 11. That is, when the sheet length is calculated, it becomes possible to calculate the sheet length before the leading end of the sheet is nipped by the downstream feeding roller pair. That is, vibration of the sheet due to the nipping of the leading end of the sheet by the downstream feeding roller pair can be suppressed, so that it becomes possible to detect the sheet length with accuracy.

As shown in FIG. 14, the first detecting portion S1 is constituted by the sensors S1A and S1B disposed at overlapping positions with respect to the feeding direction D1 and at different positions with respect to the widthwise direction W. Also, the sensors S2A, S2B, S3A, and S3B are in the same positional relationship as the sensors S1A and S1B. Accordingly, it is possible to acquire the feeding speed and the length of the sheet S with respect to the feeding direction D1 at each of the sensors disposed on one side with respect to the widthwise direction W, for example, the sensors S1B, S2B, and S3B disposed on an upper side of FIG. 14, and the sensors S1A, S2A, and S3A disposed on a lower side of FIG. 14.

Specifically, by applying the constitution of the embodiment 1, a speed VB is calculated on the basis of signals of the sensors S1B, S2B, and S3B disposed on the upper side of FIG. 14, and a speed VA is calculated on the basis of signals of the sensors S1A, S2A, and S3A. Further, calculation is made in accordance with the following (formula 4-1), so that a feeding speed V of the sheet S is acquired from an average of the speed VA and the speed VB.

$$\text{Feeding speed } V=(VA+VB)/2 \quad \text{(formula 4-1)}$$

Next, a length LB of the sheet S is calculated on the basis of the sheet feeding speed V acquired by the calculation and the signals of the sensors S1B, S2B, and S3B disposed on the upper side. Further, a length LB is calculated on the basis of the sheet feeding speed V acquired by the calculation and the signals of the sensors S1A, S2A, and S3A disposed on the lower side. Then, as shown in the following (formula 4-2), calculation is made, so that the length L of the sheet S with respect to the feeding direction D1 is acquired from an average of the length LA and the length LB.

$$\text{Length } L=(LA+LB)/2 \quad \text{(formula 4-2)}$$

Thus, in this embodiment, by disposing the two sensors with respect to the widthwise direction W, it becomes possible to use data which is twice the data in the case of a single sensor, so that the calculation error due to the variation in detection of the end portion of the sensor can be made further small.

<Modified Embodiment of Embodiment 4>

Figure 15:
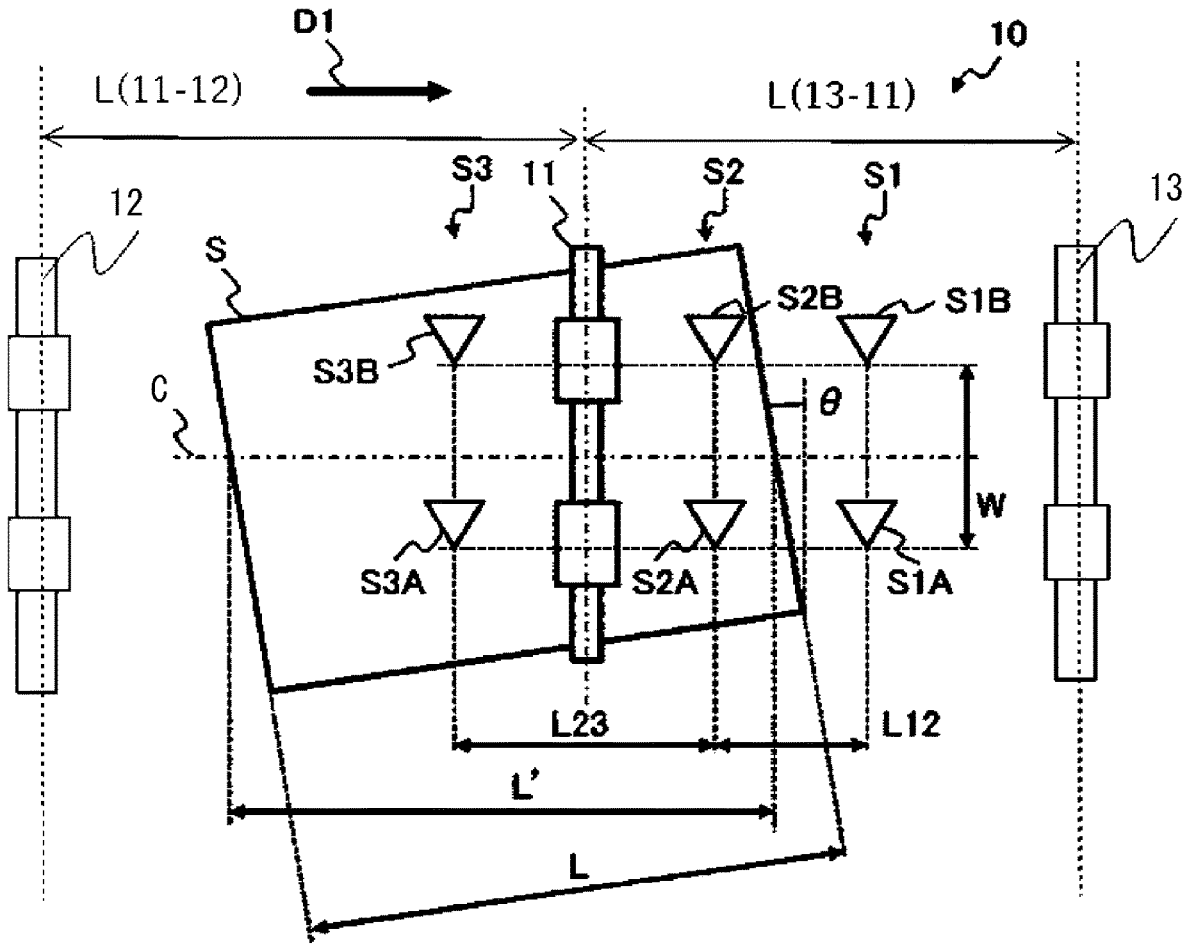
FIG. 15 is a top view showing sheet feeding behavior in a modified embodiment of the embodiment 4.
Figure 16:
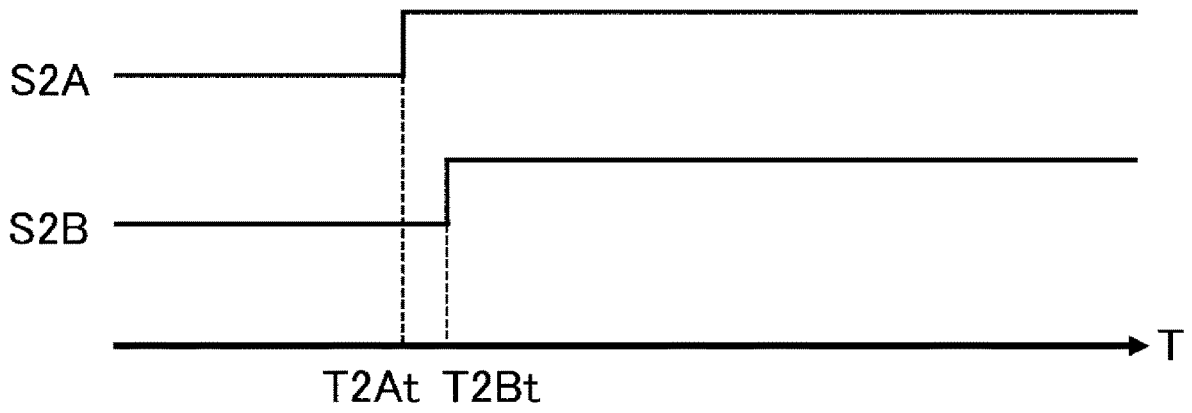
FIG. 16 is a time chart showing a change in signal in a sheet detecting unit in the modified embodiment of the embodiment 4.

Next, with reference to FIGS. 15 and 16, as a modified embodiment of the embodiment 4, a calculation method of the length of the sheet S with respect to the feeding direction D1 will be described. FIG. 15 is a top view showing a state in which the sheet S in an inclined state by an oblique movement angle θ is fed in the sheet detecting unit 10. Further, FIG. 16 is a schematic view showing changes in signals outputted from the sensors S2A and S2B of the second detecting portion S2 in the state of FIG. 15. In FIG. 16, timings when the leading end of the sheet S passes through the sensors 2A and S2B are indicated by T2At and T2Bt, respectively. As shown in FIG. 15, in the case where the sheet S is obliquely moved and fed, the length of the sheet S with respect to the feeding direction calculated in the (formula 4-2) is a length (length L') of the sheet measured along a feeding center C with respect to the widthwise direction W. On the other hand, in this embodiment of the first detecting portion S1, the second detecting portion S2, and the third detecting portion S3, for example, on the basis of changes in signals outputted from the sensors S2A and S2B, the oblique movement angle θ of the sheet S is calculated, so that the length of the sheet with respect to the feeding direction is acquired.

As shown in FIG. 15, in the case where the sheet S is fed while forming the oblique movement angle θ with respect to the feeding direction D1, as shown in FIG. 16, timings when the signals of the sensors S2A and S2B become High are different from each other by a time (T2Bt−T2At). The controller 9 calculates the oblique movement angle θ by performing calculation as in the following (formula 4-3) on the basis of the feeding speed V acquired from the (formula 4-1), the time (T2At−T2Bt), and a length W1 which is an interval between the sensor S2A and the sensor S2B.

$$\text{Oblique movement angle } \theta = \tan^{-1}\{(T2Bt - T2At) \times V/W\} \quad \text{(formula 4-3)}$$

Further, on the basis of the thus-calculated oblique movement angle θ, the length L' calculated in the (formula 4-2) is corrected by the following (formula 4-4), so that a length L of the sheet S with respect to the feeding direction D1.

$$\text{Length } L = L' \cos\theta \quad \text{(formula 4-4)}$$

Thus, in this embodiment, even in the case where the sheet S is obliquely moved, the length L of the sheet S with respect to the feeding direction D1 can be accurately calculated without being subjected to the influence when the sheet S enters the downstream feeding roller pair 13. In actuality, the sheet fed is somewhat moved obliquely, and therefore, by carrying out this embodiment, it is possible to calculate the sheet feeding speed and the sheet length more accurately. That is, on the basis of the sheet length L, the sheet feeding timing by the oblique movement correcting portion is controlled, whereby it becomes possible to suppress the positional deviation of the images, formed on the sheet S, between the front and back sides.

Embodiment 5

<Constitution for Calculating Sheet Length with Respect to Feeding Direction in Embodiment 5>

Figure 17:
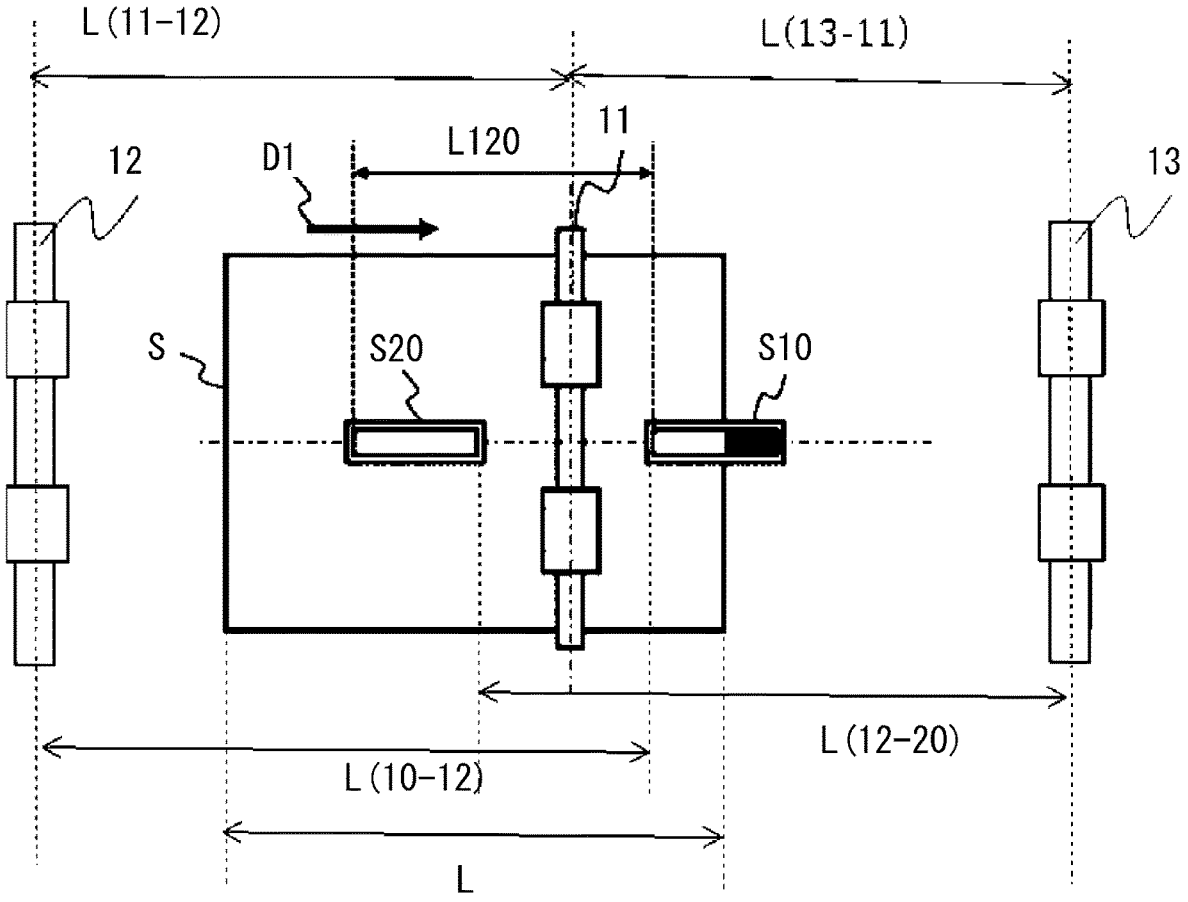
FIG. 17 is a top view showing a structure of a sheet detecting unit in an embodiment 5.

Next, a constitution for calculating the sheet length with respect to the feeding direction in the embodiment 5 will be described. FIG. 17 is a top (plan) view showing a structure of a sheet detecting unit 10 for calculating the sheet length with respect to the feeding direction in the embodiment 5.

A difference from the embodiments 1 to 4 is a kind of detecting portions disposed on sides upstream and downstream of the feeding roller pair 11. Specifically, CISs (Contact Image Sensor) capable of reading the end portions of the sheet are disposed. Incidentally, constitutions of the printer 1, the feeding roller pair 11, the upstream feeding roller pair 12, and the downstream feeding roller pair 13 are similar to those in the embodiment 1, and therefore, will be omitted from redundant description. As regards the sheet detecting unit 10, description will be made assuming that the sheet detecting unit 10 is disposed at a double-side feeding portion 502, but the sheet detecting unit 10 can also be disposed at a position other than the double-side feeding portion 502 when the sheet detecting unit 10 is on a feeding passage on which the sheet S is fed in the printer 1.

The sheet detecting unit 10 includes a feeding roller pair 11 for feeding the sheet S, and a first reading portion S10 and a second reading portion S20 which extend along the feeding direction D1. The first reading portion S10 is provided on either one of sides upstream and downstream of the feeding roller pair 11 with respect to the feeding direction D1 and reads the end portion of the sheet S fed in the sheet detecting unit 10. The second reading portion S20 is provided on the other one of the sides upstream and downstream of the feeding roller pair 11 with respect to the feeding direction D1 and reads the end portion of the sheet S fed in the sheet detecting unit 10. Incidentally, in FIG. 17, the first reading portion S10 is disposed downstream of the feeding roller pair 11 and upstream of the downstream feeding roller pair 13 with respect to the feeding direction D1. Further, the second reading portion S10 is disposed upstream of the feeding roller pair 11 and downstream of the upstream feeding roller pair 12. Further, in FIG. 17, a distance from an upstream end of the first reading portion S10 to an upstream end of the second reading portion S20 with respect to the feeding direction D1 is indicated as a distance L120. As the first reading portion S10 and the second reading portion S20, for example, CISs are used.

Figure 18A:
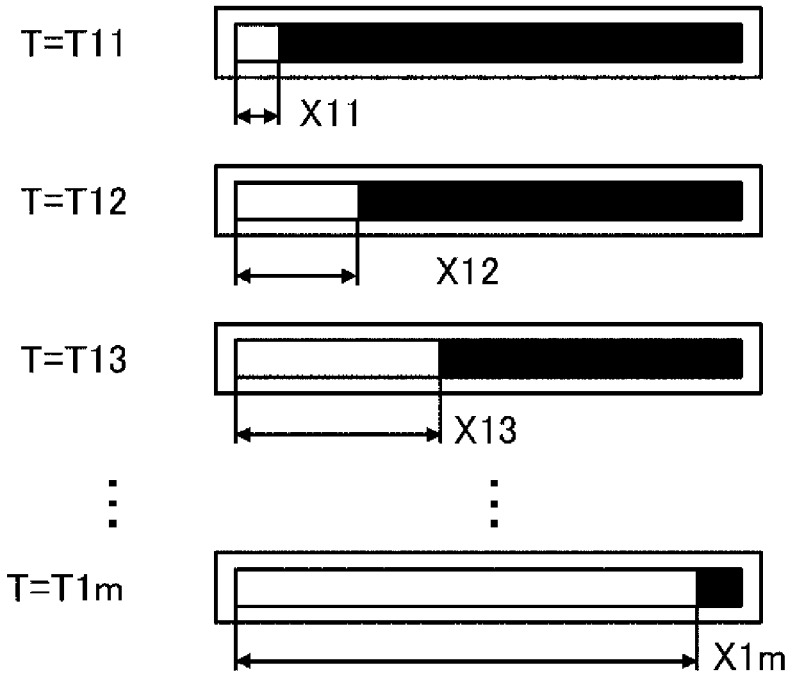
FIG. 18A and FIG. 18B are schematic views showing an example and another example, respectively of reading images by a first reading portion and a second reading portion, respectively, in the embodiment 5.
Figure 19A:
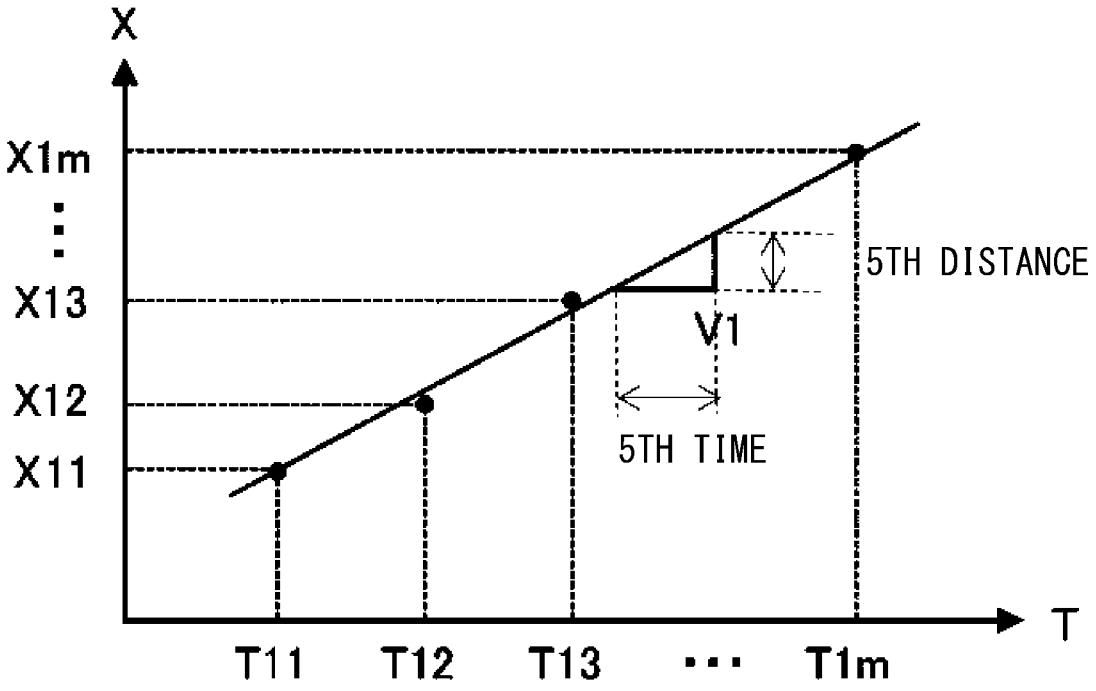
FIG. 19A is a graph showing a relationship between a reading timing by a first reading portion in the embodiment 5.

FIG. 18A is a schematic view showing an example of a plurality of images read by the first reading portion S10. FIG. 19A is a graph in which a relationship between a reading timing T when each of the plurality of images read by the first reading portion S10 and a position X of an end portion of the sheet for each of the plurality of images is plotted. As shown in FIG. 18A and FIG. 19A, the first reading portion S10 is capable of reading the images of the end portion of the sheet, fed in the sheet detecting unit 10, every certain timing. In FIG. 18A and FIG. 19A, the position X of the end portion of the sheet read by the first reading portion S10 is represented by X11 at a time T11, X12 at a time T12, . . . , and X1*m* at a time T1*m*.

Figure 18B:
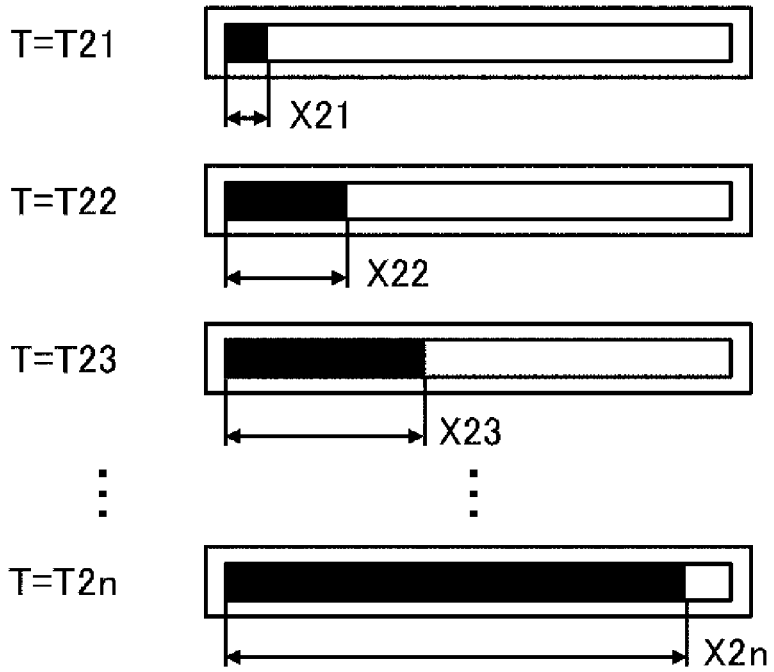
Figure 19B:
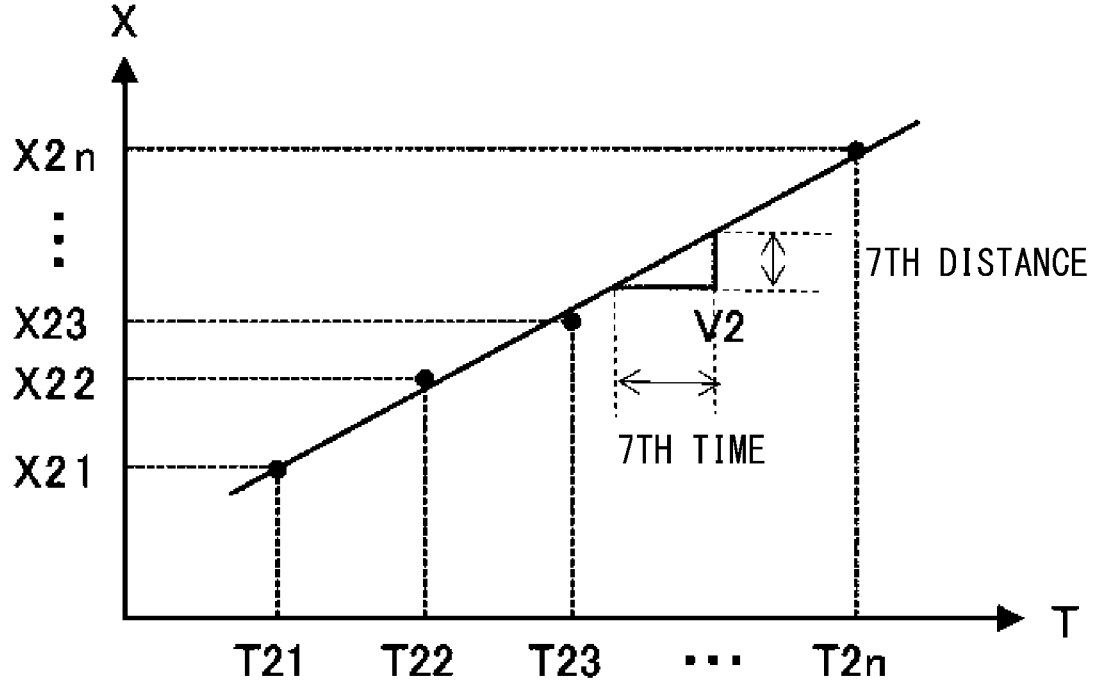
FIG. 19B is a graph showing a relationship between a reading timing by a second reading portion in the embodiment 5.

Further, FIG. 18B is a schematic view showing an example of a plurality of images read by the second reading portion S20. FIG. 19B is a graph in which a relationship between a reading timing T when each of the plurality of images read by the second reading portion S20 and a position X of an end portion of the sheet for each of the plurality of images is plotted. As shown in FIG. 18B and FIG. 19B, the second reading portion S20 is capable of reading the images of the end portion of the sheet, fed in the sheet detecting unit 10, every certain timing. In FIG. 18B and FIG. 19B, the position X of the end portion of the sheet read by the second reading portion S20 is represented by X21 at a time T21, X22 at a time T22, . . . , and X2*n* at a time T2*n*.

Incidentally, in FIG. 18A and FIG. 18B, a region in which the sheet is detected is represented by a while background, and a region in which the sheet is not detected is represented by a black background. Thus, the first reading portion S10 and the second reading portion S20 are capable of reading the change in position of the end portion of the sheet when the end portion of the sheet passes through the sheet detecting unit 10, as one of the plurality of continuous images, for each of certain timings. Further, the images read by the first reading portion S10 and the second reading portion S20 are transmitted to the controller 9. The controller 9 calculates the sheet feeding speed and the sheet length with respect to the feeding direction on the basis of the images read by the first reading portion S10 and the second reading portion S20.

Further, in the case where the length of the sheet S is L, a length between the feeding roller pair 11 and the upstream feeding roller pair 12 is L(11–12), a length between the downstream feeding roller pair 13 and the feeding roller pair 11 is L (13–11), a length between the upstream end of the first reading portion S10 and the upstream feeding roller pair 12 is L (10–12), and a length between the downstream feeding roller pair 13 and the downstream end of the second reading portion S20 is a L (12–20), the feeding roller pairs and the detecting portions are detected so as to satisfy the following relationships:

$$L>L(11-12) \text{ and } L>L(13-11) \quad \text{formula (11)}$$

$$L(10-12)>L \text{ and } L(12-20)>L \quad \text{formula (12)}$$

As regards the respective feeding roller pairs and the respective reading portions, by disposing the feeding roller pairs and the detecting portions so as to satisfy the relationships of the formula (11) and the formula (12), the sheet detecting unit 10 is capable of detecting the leading end and the trailing end of the sheet S by the first reading portion and the second reading portion in a state in which the sheet S is not nipped by the upstream feeding roller pair and the downstream feeding roller pair during feeding of the sheet S by the feeding roller pair 11. That is, when the sheet length is calculated, it becomes possible to calculate the sheet length before the leading end of the sheet is nipped by the downstream feeding roller pair. That is, vibration of the sheet due to the nipping of the leading end of the sheet by the downstream feeding roller pair can be suppressed, so that it becomes possible to detect the sheet length with accuracy. Incidentally, also, as regards this embodiment 5, as a modified embodiment, a constitution similar to the modified embodiments of the embodiments 1 to 3 may also be employed. That is, after the leading end of the sheet is nipped by the downstream feeding roller pair 13, the trailing end of the sheet may also be detected by the second reading portion.

The controller 9 plots the relationship between the reading timings T of the plurality of images on the basis of the images read by the first reading portion S10 and the second reading portion S20 and the positions of the end portions of the sheet for the plurality of associated images, and performs linear approximation by the method of least squares. Then, in a plot after the linear approximation, a slope of a rectilinear line is used as the sheet feeding speed. As shown in FIG. 19A, a slope of a rectilinear line obtained by plotting a difference between two points of either of T11, T12, . . . , T1*m* and a difference between positions of the sheet end portion for the images X11, X12, . . . , X1*m* read at each point of the times is V1. As shown in FIG. 19B, a slope of a rectilinear line obtained by plotting a difference between two points of either of T21, T22, T2*n* and a difference between positions of the sheet end portion for the images X21, X22, X2*n* read at each point of the times is V2. Further, when the sheet feeding speed is determined as V1 from the slope of the rectilinear line acquired in FIG. 19A and the sheet feeding speed is determined as V2 from the slope of the rectilinear line acquired in FIG. 19B, the sheet feeding speed V is calculated as in the following (formula 5-1).

$$\text{Feeding speed } V=(V1+V2)/2 \quad \text{(formula 5-1)}$$

A difference in timing between two points of either of T11, T12, . . . , T1*m* is an example of a fifth time in this embodiment. Further, a difference in position of the sheet end portion for the images X11, X12, . . . , X1*m* read at the associated time is an example of a fifth distance. Further, the feeding speed V1 is a third speed in this embodiment. Further, a difference in timing between two points of either of T21, T22, . . . , T2*n* is an example of a seventh time in this embodiment, and a difference in position of the sheet end portion for the images X21, X22, . . . , X2*n* read at the associated time is an example of a seventh distance. Further, the feeding speed V2 is a fourth speed in this embodiment.

Figures 20A, 20B:
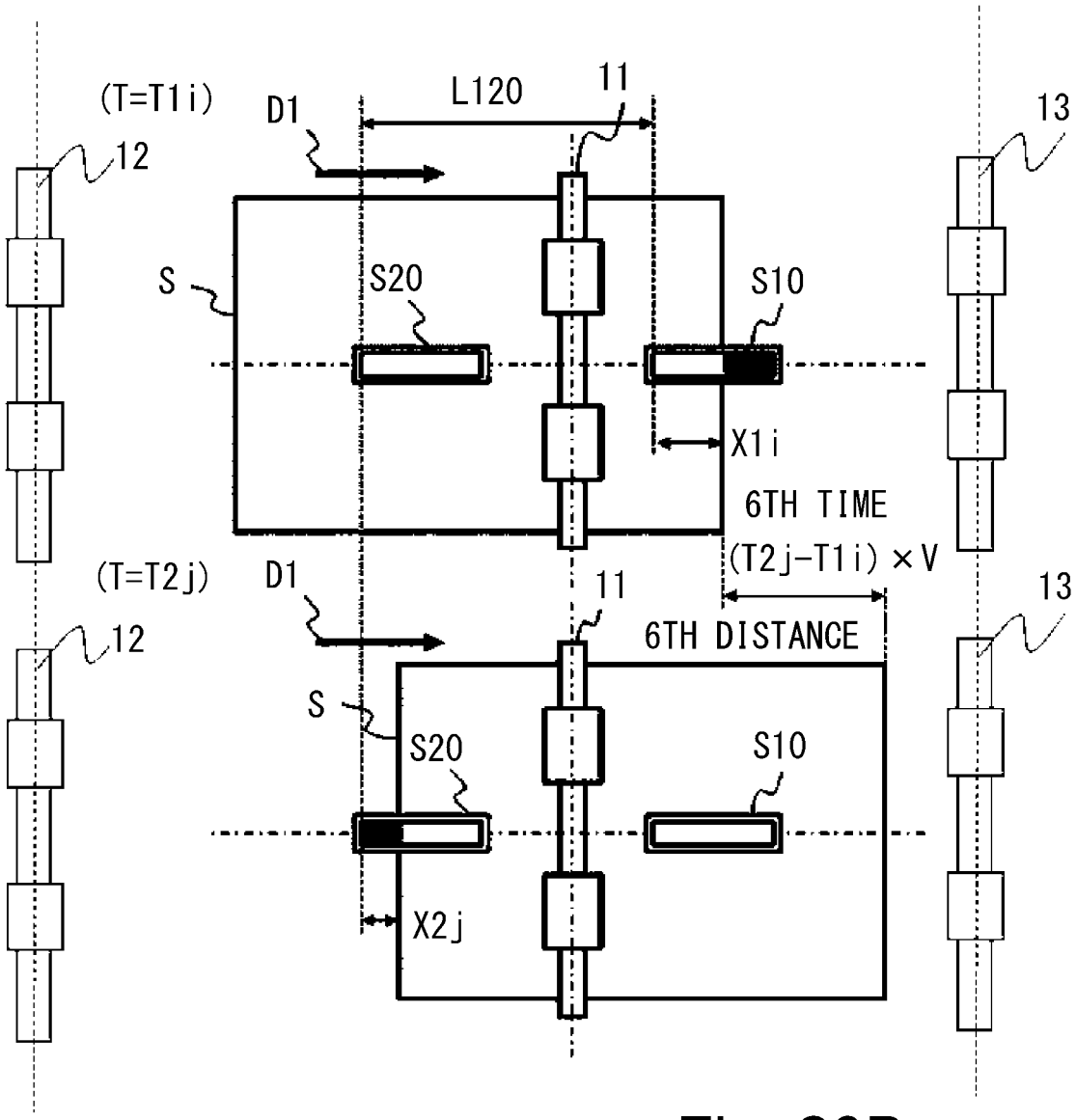
FIG. 20A and FIG. 20B are top views showing detection of a leading end portion and a trailing end portion, respectively, of a sheet in the embodiment 5.

Next, a method of calculating the length L of the sheet with respect to the feeding direction D1 will be described using the sheet feeding speed V. As shown in FIG. 20A, a position of the leading end of the sheet read by the first reading portion S10 at a time T=T1*i* is referred to as X1*i*. As shown in FIG. 20B, a position of the trailing end of the sheet read by the first reading portion S20 at a time T=T2*j* is referred to as X2*j*. At this time, a distance in which the sheet is fed in a time T=T1*i* to T2*j* can be expressed by (T2*j*–T1*i*)×V.

A sixth time in this embodiment corresponds to a timing difference between the reading time T1*i* by the first reading portion 510 and the reading time T2*j* by the second reading portion S20. Further, a sixth distance in this embodiment corresponds to a difference between the leading end position X1*i* of the sheet read by the first reading portion S10 and the trailing end position X2*j* of the sheet read by the second reading portion S20.

The controller 9 calculates, as in the following (formula 5-2), a length Lij of the sheet calculated from data of the time T=T1*i* and the time T=T2*j* on the basis of the distance ((T2*j*–T1*i*)×V), the distance L120, the leading end position X1*i* of the sheet, and the trailing end position X2*j* of the sheet.

$$\text{Length } Lij=(T2j-T1i)\times V+L120+X1i-X2j \quad \text{(formula 5-2)}$$

Then, the controller 9 calculates, as in the following (formula 5-3), a length L of the sheet with respect to the feeding direction D1 on the basis of all the images read by the first reading portion S10 and the second reading portion S20.

$$\text{Length } L=\Sigma[i=1\rightarrow m]\Sigma[j=1\rightarrow n]$$

$$\{(T2j-T1i)\times V+L120+X1i-X2j\}/m\times n \quad \text{(formula 5-3)}$$

Thus, in this embodiment, the sheet length L is calculated on the basis of the position change in sheet trailing end before the sheet leading end passes through the downstream feeding roller pair 13 and on the basis of the position change in sheet trailing end after the sheet leading end passes through the feeding roller pair 11. Accordingly, the length L of the sheet S with respect to the feeding direction D1 can be accurately calculated without being subjected to the influence when the sheet S enters the downstream feeding roller pair 13. That is, on the basis of the sheet length L, the sheet feeding timing by the oblique movement correcting portion is controlled, whereby it becomes possible to suppress the positional deviation of the images, formed on the sheet S, between the front and back sides.

Other Embodiments

The printers 1 from the embodiment 1 to the embodiment 5 are an example of the image forming apparatus, and for example, may also be an image forming apparatus including an image forming means of an ink jet type in place of the electrophotographic type. Further, there is an image forming apparatus including auxiliary equipment, such as an option feeder or a sheet processing device, in addition to an apparatus main assembly including the image forming means, but constitutions corresponding to the sheet feeding devices described from the embodiments 1 to 5 may also be used for feeding of the sheet S in such auxiliary equipment.

Figure 21:
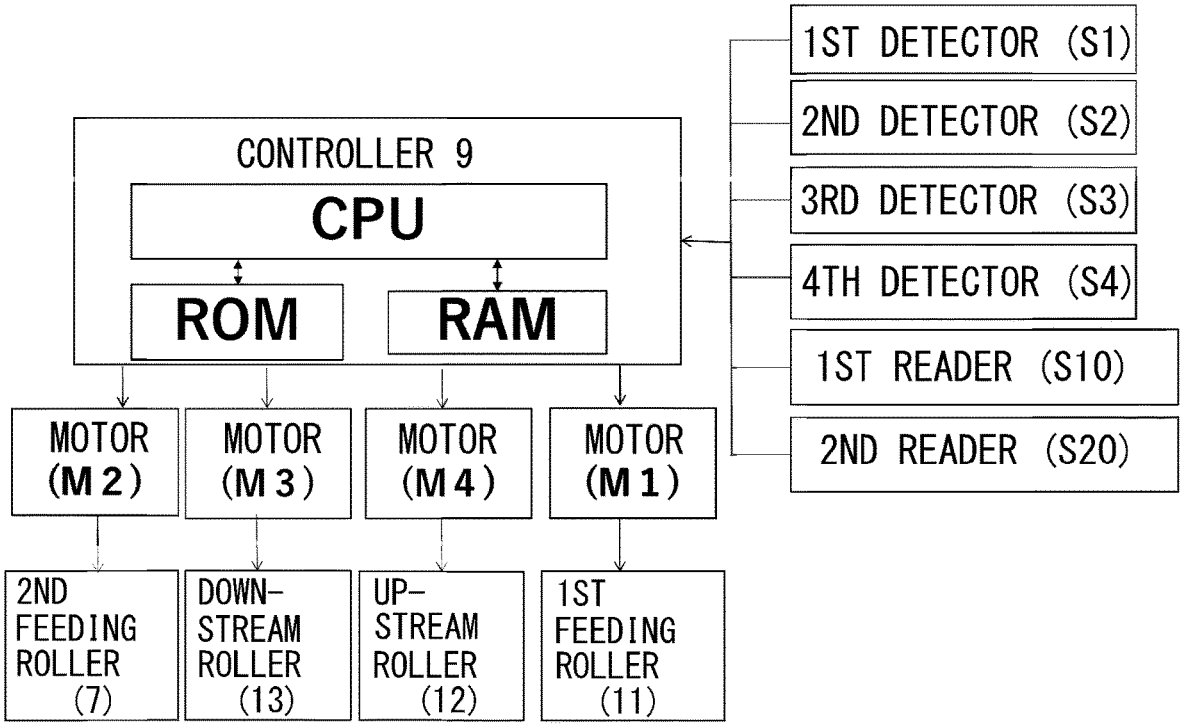
FIG. 21 is a control block diagram in the embodiments 1 to 5.

In FIG. 21, a control block diagram in the embodiments 1 to 5 is shown. The controller 9 from the embodiment 1 to 5 includes a central processing unit (CPU) and a memory. The CPU loads and executes a program stored in the memory and carries out integrated control of the printer 1 in cooperation with respective functional portions exhibiting specific functions. The memory includes a non-volatile storing medium such as a read-only memory (ROM) and a volatile storing medium such as a random-access memory (RAM), and not only constitutes a storing place for programs and data but also becomes a working area when the CPU executes the program. Further, the memory is an example of a non-transient storing medium in which the program for controlling the printer 1 is stored. Incidentally, the controller 9 may also be mounted as an independent hardware, on a circuit of the controller and may also be mounted as a functional unit of the program executed by the CPU or another processing device, in a software-like manner.

The controller rotates respective motors connected to respective rollers on the basis of pieces of information of the first to fourth detecting portions and the first and second reading portions. Further, as regards the rotation of the motors, it is possible to control a rotation timing and a rotational speed, and the rotation timing and the rotational speed are controlled on the basis of the pieces of information of the respective detecting portions and the respective reading portions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2020-148277 filed on Sep. 3, 2020, and 2021-126405 filed on Aug. 2, 2021, which are hereby incorporated by reference herein in its entirety.

What is claimed is:

1. A sheet feeding device comprising:

a first feeding roller pair rotatable in a sheet nipping state and configured to feed a sheet;

an upstream feeding roller pair provided upstream of said first feeding roller pair with respect to a sheet feeding direction and configured to feed the sheet;

a downstream feeding roller pair provided downstream of said first feeding roller pair with respect to the sheet feeding direction and configured to feed the sheet;

a second feeding roller pair provided downstream of said downstream feeding roller pair with respect to the sheet feeding direction and configured to feed the sheet;

a first detecting portion provided at a first detecting position downstream of said first feeding roller pair and upstream of said downstream feeding roller pair with respect to the sheet feeding direction and configured to detect passing of a leading end portion of the sheet fed by said first feeding roller pair;

a second detecting portion provided at a second detecting position, different from the first detecting position, downstream of said first feeding roller pair and upstream of said downstream feeding roller pair with respect to the sheet feeding direction and configured to detect the passing of the leading end portion of the sheet fed by said first feeding roller pair;

a third detecting portion provided at a third detecting position upstream of said first feeding roller pair and downstream of said upstream feeding roller pair with respect to the sheet feeding direction and configured to detect passing of a trailing end portion of the sheet fed by said first feeding roller pair; and a controller configured to perform calculation in response to signals from said first detecting portion, said second detecting portion, and said third detecting portion, wherein said controller calculates a sheet feeding speed on the basis of a first time which is a difference between a timing when the leading end portion of the sheet passes through the first detecting position and a timing when the leading end portion of the sheet passes through the second detecting position and a first distance between the first detecting position and the second detecting position with respect to the sheet feeding direction, wherein said controller calculates a length of the sheet with respect to the sheet feeding direction on the basis of the sheet feeding speed, a second time which is a difference between a timing when the leading end portion of the sheet passes through the second detecting position and a timing when the trailing end portion of the sheet passes through the third detecting position, and a second distance between the second detecting position and the third detecting position with respect to the sheet feeding direction, and wherein said controller controls a sheet feeding timing by said second feeding roller pair on the basis of information of the length of the sheet.

2. A sheet feeding device according to claim 1, wherein when the leading end portion of the sheet fed by said first feeding roller pair is detected by said first detecting portion and said second detecting portion, the trailing end portion of the sheet passes through said upstream feeding roller pair, and wherein when the trailing end portion of the sheet fed by said first feeding roller pair is detected by said third detecting portion, the leading end portion does not reach said downstream feeding roller pair.

3. A sheet feeding device according to claim 1, wherein the calculated length of the sheet is a first length, wherein said controller calculates a second length of the sheet with respect to the sheet feeding direction on the basis of the sheet feeding speed, a third time which is a difference between the timing when the leading end portion of the sheet passes through the first detecting position and the timing when the trailing end portion of the sheet passes through the third detecting position, and a third distance between the first detecting position and the third detecting position with respect to the sheet feeding direction, and wherein said controller calculates a length of the sheet with respect to the sheet feeding direction on the basis of the first length and the second length, and controls the sheet feeding timing by said second feeding roller pair on the basis of information of the length of the sheet.

4. A sheet feeding device according to claim 1, wherein each of said first detecting portion, said second detecting portion, and said third detecting portion includes a plurality of detecting portions with an interval with respect to a widthwise direction of the sheet perpendicular to the sheet feeding direction, and wherein said controller calculates an angle of oblique movement of the sheet on the basis of a difference between a timing when the leading end portion of the sheet passes through one of said plurality of detecting portions and a timing when the leading end portion of the sheet passes through the other one of said plurality of detecting portions, and corrects the length of the sheet on the basis of the angle of oblique movement.

5. A sheet feeding device according to claim 1, wherein said first feeding roller pair is subjected to blasting at a peripheral surface thereof contactable to the sheet.

6. An image forming apparatus comprising:

a sheet feeding device according to claim 1; and image forming means configured to form an image on the sheet fed by said sheet feeding device.

7. An image forming apparatus according to claim 6, further comprising a double-side feeding portion configured to reverse the sheet on which the image is formed by said image forming means and then to feed the sheet to said image forming means again, and wherein said sheet feeding device calculates the length of the sheet fed through said double-side feeding portion.

8. A sheet feeding device comprising:

a first feeding roller pair rotatable in a sheet nipping state and configured to feed a sheet;

an upstream feeding roller pair provided upstream of said first feeding roller pair with respect to a sheet feeding direction and configured to feed the sheet;

a downstream feeding roller pair provided downstream of said first feeding roller pair with respect to the sheet feeding direction and configured to feed the sheet;

a second feeding roller pair provided downstream of said downstream feeding roller pair with respect to the sheet feeding direction and configured to feed the sheet;

a first detecting portion provided at a first detecting position upstream of said first feeding roller pair and downstream of said upstream feeding roller pair with respect to the sheet feeding direction and configured to detect passing of a trailing end portion of the sheet fed by said first feeding roller pair;

a second detecting portion provided at a second detecting position, different from the first detecting position, upstream of said first feeding roller pair and downstream of said upstream feeding roller pair with respect to the sheet feeding direction and configured to detect the passing of the trailing end portion of the sheet fed by said first feeding roller pair;

a third detecting portion provided at a third detecting position downstream of said first feeding roller pair and upstream of said downstream feeding roller pair with respect to the sheet feeding direction and configured to detect passing of a leading end portion of the sheet fed by said first feeding roller pair; and a controller configured to perform calculation in response to signals from said first detecting portion, said second detecting portion, and said third detecting portion, wherein when the leading end portion of the sheet fed by said first feeding roller pair is detected by said third detecting portion, the trailing end portion of the sheet passes through said upstream feeding roller pair, wherein when the trailing end portion of the sheet fed by said first feeding roller pair is detected by said first detecting portion and said second detecting portion, the leading end portion does not reach said downstream feeding roller pair, wherein said controller calculates a sheet feeding speed on the basis of a first time which is a difference between a timing when the trailing end portion of the sheet passes through the first detecting position and a timing when the trailing end portion of the sheet passes through the second detecting position and a first distance between the first detecting position and the second detecting position with respect to the sheet feeding direction, wherein said controller calculates a length of the sheet with respect to the sheet feeding direction on the basis of the sheet feeding speed, a second time which is a difference between a timing when the leading end portion of the sheet passes through the third detecting position and a timing when the trailing end portion of the sheet passes through the second detecting position, and a second distance between the second detecting position and the third detecting position with respect to the sheet feeding direction, and wherein said controller controls a sheet feeding timing by said second feeding roller pair on the basis of information of the length of the sheet.

9. A sheet feeding device according to claim 8, wherein the calculated length of the sheet is a first length, wherein said controller calculates a second length of the sheet with respect to the sheet feeding direction on the basis of the sheet feeding speed, a third time which is a difference between the timing when the leading end portion of the sheet passes through the third detecting position and the timing when the trailing end portion of the sheet passes through the first detecting position, and a third distance between the first detecting position and the third detecting position with respect to the sheet feeding direction, and wherein said controller calculates a length of the sheet with respect to the sheet feeding direction on the basis of the first length and the second length, and controls the sheet feeding timing by said second feeding roller pair on the basis of information of the length of the sheet.

10. A sheet feeding device according to claim 8, further comprising a fourth detecting portion provided at a fourth detecting position, different from the third detecting position, downstream of said first feeding roller pair and upstream of said downstream feeding roller pair with respect to the sheet feeding direction and configured to detect the passing of the leading end portion of the sheet fed by said first feeding roller pair, wherein the calculated sheet feeding speed is a first speed, wherein said controller calculates a second speed on the basis of a fourth time which is a difference between the timing when the leading end portion of the sheet passes through the third detecting position and a timing when the leading end portion of the sheet passes through the fourth detecting position and a fourth distance between the third detecting position and the fourth detecting position with respect to the sheet feeding direction, and wherein said controller calculates a sheet feeding speed on the basis of the first speed and the second speed.

11. A sheet feeding device comprising:

a first feeding roller pair rotatable in a sheet nipping state and configured to feed a sheet;

an upstream feeding roller pair provided upstream of said first feeding roller pair with respect to a sheet feeding direction and configured to feed the sheet;

a downstream feeding roller pair provided downstream of said first feeding roller pair with respect to the sheet feeding direction and configured to feed the sheet;

a second feeding roller pair provided downstream of said downstream feeding roller pair with respect to the sheet feeding direction and configured to feed the sheet;

a first reading portion provided so as to extend along the sheet feeding direction on a side downstream of said first feeding roller pair and upstream of said downstream feeding roller pair with respect to the sheet feeding direction and configured to read an image of a leading end portion of the sheet fed by said first feeding roller pair;

a second reading portion provided so as to extend along the sheet feeding direction on a side upstream of said first feeding roller pair and downstream of said upstream feeding roller pair with respect to the sheet feeding direction and configured to read an image of the trailing end portion of the sheet fed by said first feeding roller pair; and a controller configured to perform calculation depending on the images read by said first reading portion and said second reading portion, wherein when the image of the leading end portion of the sheet fed by said first feeding roller pair is read by said first reading portion, the trailing end portion of the sheet passes through said upstream feeding roller pair, wherein when the image of the trailing end portion of the sheet fed by said first feeding roller pair is read by said second reading portion, the leading end portion does not reach said downstream feeding roller pair, wherein said controller calculates a sheet feeding speed on the basis of a fifth time which is a difference in timing between a plurality of images read by said first reading portion and a fifth distance which is a difference in position of the leading end portion of the sheet between the plurality of images, wherein said controller calculates a length of the sheet on the basis of a sixth time which is a difference in timing between the image read by said first reading portion and the image read by said second reading portion, and wherein said controller controls a sheet feeding timing by said second feeding roller pair on the basis of information of the length of the sheet.

12. A sheet feeding device according to claim 11, wherein the calculated sheet feeding speed is a third speed, wherein said controller calculates a fourth speed on the basis of a seventh time which is a difference in timing between the plurality of images read by said second reading portion and a seventh distance which is a difference in end portion position of the sheet between the plurality of images, and wherein said controller calculates the sheet feeding speed on the basis of the third speed and the fourth speed.

* * * * *